US008701572B2

(12) United States Patent
Donais et al.

(10) Patent No.: US 8,701,572 B2
(45) Date of Patent: Apr. 22, 2014

(54) LOW NOX NOZZLE TIP FOR A PULVERIZED SOLID FUEL FURNACE

(75) Inventors: Richard E. Donais, West Suffield, CT (US); Todd D. Hellewell, Windsor, CT (US); Robert D. Lewis, Cromwell, CT (US); Galen H. Richards, Tremonton, UT (US); David P. Towle, Simsbury, CT (US)

(73) Assignee: ALSTOM Technology Ltd, Baden (CH)

( * ) Notice: Subject to any disclaimer, the term of this patent is extended or adjusted under 35 U.S.C. 154(b) by 659 days.

(21) Appl. No.: 12/393,439

(22) Filed: Feb. 26, 2009

(65) Prior Publication Data

US 2009/0277364 A1 Nov. 12, 2009

Related U.S. Application Data

(60) Provisional application No. 61/034,780, filed on Mar. 7, 2008, provisional application No. 61/034,796, filed on Mar. 7, 2008.

(51) Int. Cl.
*F23D 1/00* (2006.01)
*F23K 3/02* (2006.01)

(52) U.S. Cl.
USPC ..... 110/104 B; 110/261; 110/265

(58) Field of Classification Search
USPC ..... 110/104 B, 260, 261, 262, 263, 265, 110/347; 431/8, 181, 187, 186, 189
See application file for complete search history.

(56) References Cited

U.S. PATENT DOCUMENTS

| | | | | |
|---|---|---|---|---|
| 4,252,069 | A | 2/1981 | McCartney | |
| 4,274,343 | A | 6/1981 | Kokkinos | |
| 4,356,975 | A * | 11/1982 | Chadshay | 239/419.5 |
| 4,434,727 | A | 3/1984 | McCartney | |
| 4,520,739 | A | 6/1985 | McCartney et al. | |

(Continued)

FOREIGN PATENT DOCUMENTS

| | | |
|---|---|---|
| EP | 0869313 A1 | 10/1998 |
| FR | 719008 | 2/1932 |

(Continued)

OTHER PUBLICATIONS

PCT International Search Report and The Written Opinion of the International Searching Authority dated Mar. 15, 2010—(PCT/US2009/035801).

(Continued)

*Primary Examiner* — Kenneth Rinehart
*Assistant Examiner* — David J Laux
(74) *Attorney, Agent, or Firm* — James J. Cummings

(57) ABSTRACT

A nozzle tip [100] for a pulverized solid fuel pipe nozzle [200] of a pulverized solid fuel-fired furnace includes: a primary air shroud [120] having an inlet [102] and an outlet [104], wherein the inlet [102] receives a fuel flow [230]; and a flow splitter [180] disposed within the primary air shroud [120], wherein the flow splitter disperses particles in the fuel flow [230] to the outlet [104] to provide a fuel flow jet which reduces NOx in the pulverized solid fuel-fired furnace. In alternative embodiments, the flow splitter [180] may be wedge shaped and extend partially or entirely across the outlet [104]. In another alternative embodiment, flow splitter [180] may be moved forward toward the inlet [102] to create a recessed design.

20 Claims, 19 Drawing Sheets

(56) References Cited

U.S. PATENT DOCUMENTS

| | | | | |
|---|---|---|---|---|
| 4,566,393 | A * | 1/1986 | Connell et al. | 110/261 |
| 4,611,543 | A | 9/1986 | Collette | |
| 4,614,159 | A * | 9/1986 | Sugiura et al. | 110/261 |
| 4,634,054 | A * | 1/1987 | Grusha | 239/423 |
| 5,315,939 | A | 5/1994 | Rini et al. | |
| 6,089,171 | A * | 7/2000 | Fong et al. | 110/263 |
| 6,189,812 | B1 | 2/2001 | Buridant | |
| 6,439,136 | B1 | 8/2002 | Mann et al. | |
| 7,216,594 | B2 | 5/2007 | Nowak et al. | |
| 2007/0234938 | A1 | 10/2007 | Briggs, Jr. et al. | |

FOREIGN PATENT DOCUMENTS

| | | | | |
|---|---|---|---|---|
| JP | 54159743 | | 12/1979 | |
| JP | 04024404 | | 1/1992 | |
| JP | 10332110 | | 12/1998 | |
| JP | 2001082705 | | 3/2001 | |
| JP | 2002228107 | | 8/2002 | |
| JP | 2002228107 | A * | 8/2002 | F23C 11/00 |
| RU | 2038535 | | 6/1995 | |
| RU | 48027 | U1 | 9/2005 | |

OTHER PUBLICATIONS

Official Decision of Grant from the Patent Office of the Russian Federation on Aug. 20, 2013, for Russian Patent Application No. 201040953.

* cited by examiner

LOW NOX NOZZLE TIP FOR A PULVERIZED SOLID FUEL FURNACE

CROSS REFERENCE TO RELATED APPLICATIONS

The present invention claims the benefit of U.S. Provisional Patent Application Ser. No. 61/034,780, entitled "LOW NOx NOZZLE TIP", and U.S. Provisional Patent Application 61/034,796, entitled "LOW $NO_X$ NOZZLE TIP FOR A PULVERIZED SOLID FUEL FURNACE" both of which are hereby incorporated by reference as if set forth in there entirety herein.

STATEMENT REGARDING FEDERALLY SPONSORED RESEARCH OR DEVELOPMENT

The U.S. Government has rights in this invention pursuant to Contract No. DE-FC26-04NT42300 awarded by the U.S. Department of Energy.

TECHNICAL FIELD

The present disclosure relates generally to firing systems for use with pulverized solid fuel-fired furnaces, and more specifically, to a low $NO_X$ pulverized solid fuel nozzle tip providing separate and discrete air/pulverized fuel jets for use in such firing systems.

BACKGROUND

Pulverized solid fuel has been successfully burned in suspension in furnaces by tangential firing methods for a long time. The tangential firing method has many advantages, among them being good mixing of the pulverized solid fuel and air, stable flame conditions, and long residence time of combustion gases in the furnaces.

Systems for delivering the pulverized solid fuel (e.g., coal) to a steam generator typically include a plurality of nozzle assemblies through which the pulverized coal is delivered, using air, into a combustion chamber of the steam generator. The nozzle assemblies are typically disposed within windboxes, which may be located proximate to the corners of the steam generator. Each nozzle assembly includes a nozzle tip, which protrudes into the combustion chamber. Each nozzle tip delivers a single stream, or jet, of the pulverized coal and air into the combustion chamber. After leaving the nozzle tip, the single pulverized coal/air jet disperses in the combustion chamber.

Typically, the nozzle tips are arranged to tilt up and down to adjust the location of the flame within the combustion chamber. The flames produced at each pulverized solid fuel nozzle are stabilized through global heat- and mass-transfer processes. Thus, a single rotating flame envelope (e.g., a "fireball"), centrally located in the furnace, provides gradual but thorough and uniform pulverized solid fuel-air mixing throughout the entire furnace.

Recently, more and more emphasis has been placed on minimization of air pollution. In connection with this, with reference in particular to the matter of $NO_X$ control, it is known that oxides of nitrogen are created during fossil fuel combustion primarily by two separate mechanisms which have been identified to be thermal $NO_X$ and fuel $NO_X$. Thermal $NO_X$ results from the thermal fixation of molecular nitrogen and oxygen in the combustion air. The rate of formation of thermal $NO_X$ is extremely sensitive to local flame temperature and somewhat less sensitive to local concentration of oxygen. Virtually all thermal $NO_X$ is formed at a region of the flame which is at the highest temperature. The thermal $NO_X$ concentration is subsequently "frozen" at a level prevailing in the high temperature region by the thermal quenching of the combustion gases. The flue gas thermal $NO_X$ concentrations are, therefore, between the equilibrium level characteristic of the peak flame temperature and the equilibrium level at the flue gas temperature.

On the other hand, fuel $NO_X$ derives from the oxidation of organically bound nitrogen in certain fossil fuels such as coal and heavy oil. The formation rate of fuel $NO_X$ is highly affected by the rate of mixing of the fossil fuel and air stream in general, and by the local oxygen concentration in particular. However, the flue gas $NO_X$ concentration due to fuel nitrogen is typically only a fraction, e.g., approximately 20 to 60 percent, of the level which would result from complete oxidation of all nitrogen in the fossil fuel. From the preceding, it should thus now be readily apparent that overall $NO_X$ formation is a function both of local oxygen levels and of peak flame temperatures.

Although the pulverized solid fuel nozzle tips of the prior art are operative for their intended purposes, there has nevertheless been evidenced in the prior art a need for such pulverized solid fuel nozzle tips to be further improved, specifically in the pursuit of reduced air pollution, e.g., $NO_X$ emissions. More specifically, a need has been evidenced in the prior art for a new and improved low $NO_X$ pulverized solid fuel nozzle tip for use in a tangential firing system that would enable more flexibility in the control of undesirable emissions such as nitric oxides.

SUMMARY

According to the aspects illustrated herein, there is provided a nozzle tip for a pulverized solid fuel pipe nozzle of a pulverized solid fuel-fired furnace. The nozzle tip includes: a primary air shroud having an inlet and an outlet, wherein the inlet receives a fuel flow; and a flow separator disposed within the primary air shroud, wherein the flow separator disperses the fuel flow from the outlet to provide a fuel flow jet which reduces $NO_X$ in the pulverized solid fuel-fired furnace The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

As with all of the figures, elements with the same reference numbers perform the same or very similar function with the same or very similar structure. Therefore, a description in connection with one figure will apply to the element having the same reference number in all other figures.

Disclosed herein is a low $NO_X$ pulverized solid fuel nozzle tip, and more specifically, a pulverized solid fuel nozzle tip that provides separate and discrete air/pulverized fuel jets for use in a firing system of a pulverized solid fuel-fired furnace. As compared to a nozzle providing a single air/pulverized fuel jet, penetration of the separate and discrete air/pulverized fuel jets is decreased, and a surface area thereof is increased. As a result, $NO_x$ emissions of the pulverized solid fuel-fired furnace are substantially reduced and/or effectively minimized, as will hereinafter be described in further detail with reference to the accompanying drawings.

Figure 1:
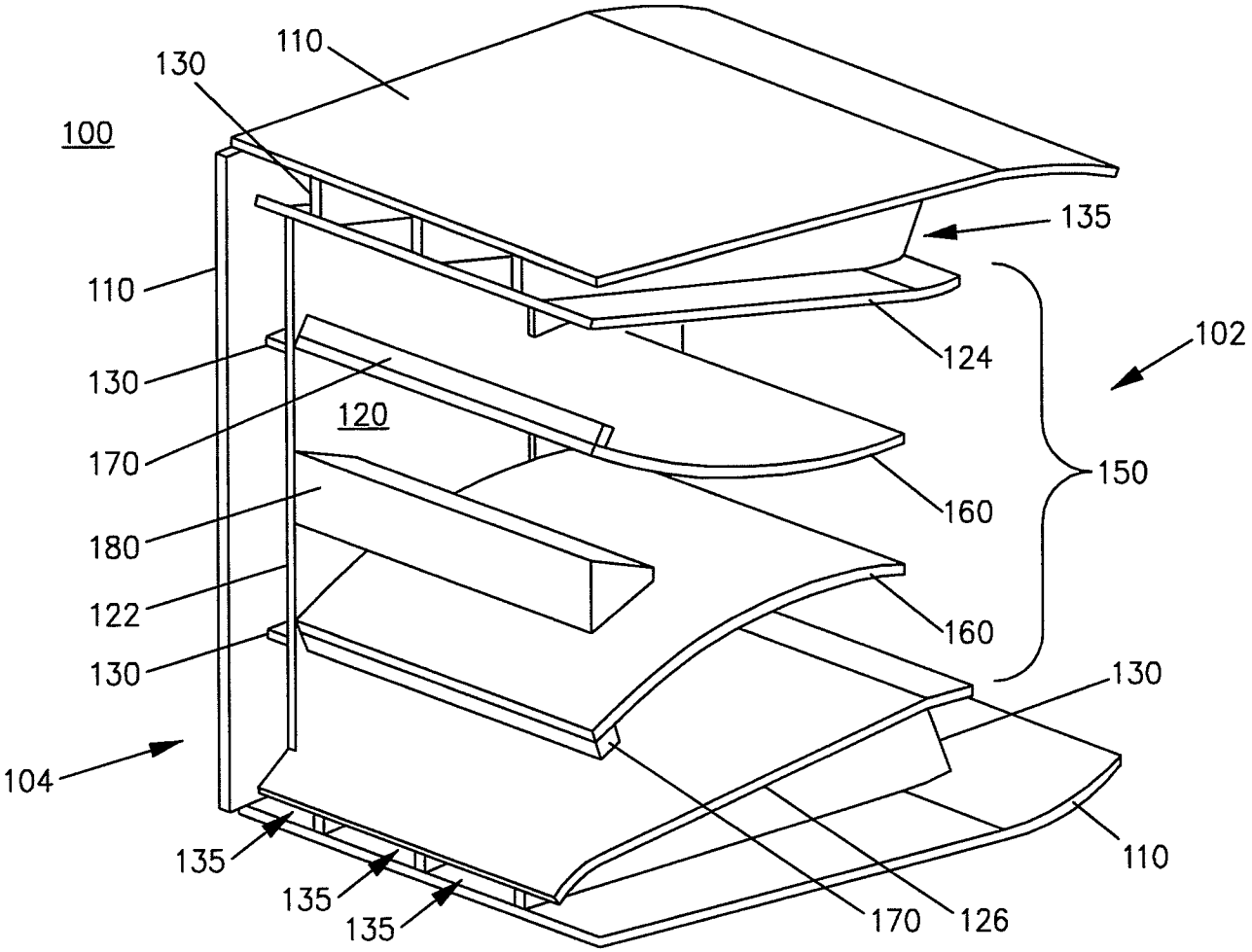
FIG. 1 is a cutaway front perspective view of a nozzle tip according to an exemplary embodiment of the present invention.
Figure 2:
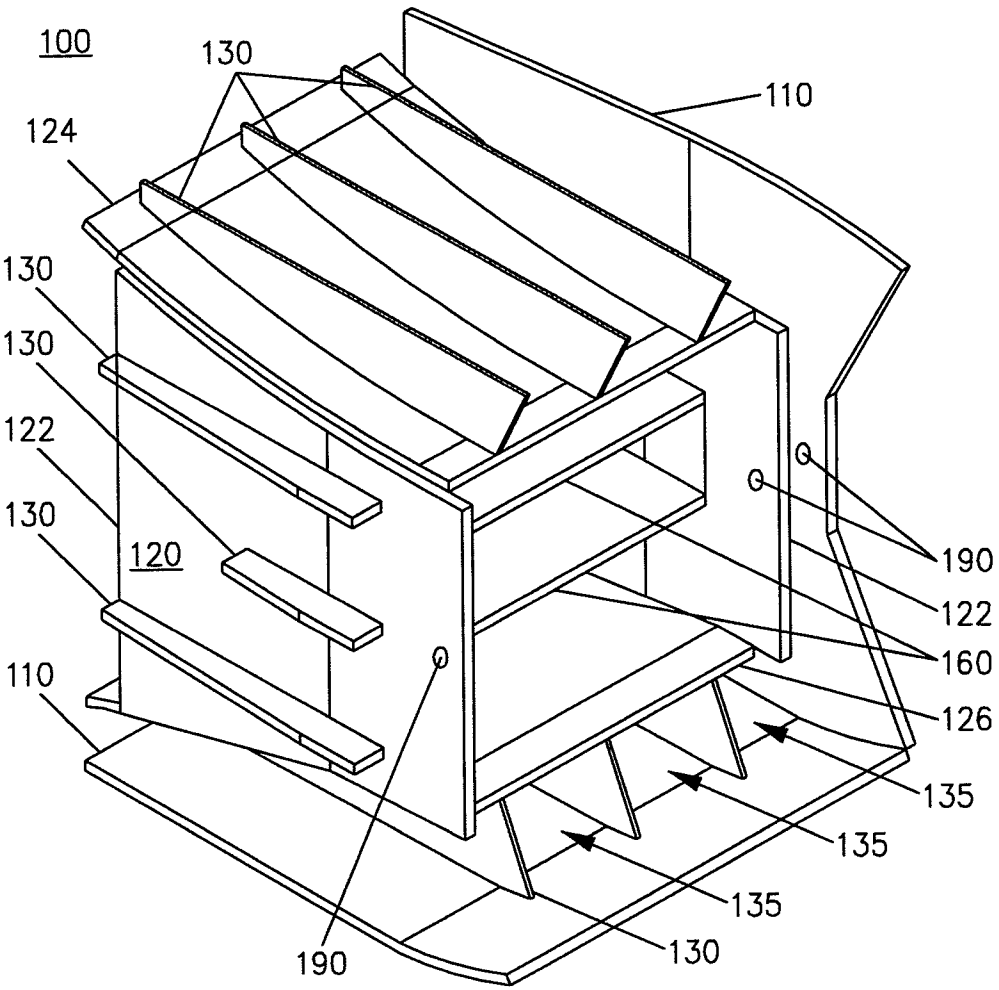
FIG. 2 is a cutaway rear perspective view of the nozzle tip of FIG. 1.

Referring to FIGS. 1 and 2, a nozzle tip 100 having an inlet end 102 and an outlet end 104 includes a secondary air (SA) shroud 110 and a primary air (PA) shroud 120 enclosed therein. The PA shroud 120 includes PA shroud side plates 122, a PA shroud top plate 124 and a PA shroud bottom plate 126.

The SA shroud 110 is supported by supports 130 located between the SA shroud 110 and the PA shroud 120. Further, an SA duct 135 substantially surrounds the PA shroud 110. Specifically, the SA duct 135 includes spaces created between the supports 130 and the PA shroud top plate 124, the supports 130 and the PA shroud bottom plate 126, and spaces created between the supports 130 and the PA shroud side plates 122.

A primary air-pulverized solid fuel (PA-PSF) duct 150 is formed in a space created within the PA shroud side plates 122, the PA shroud top plate 124 and the PA shroud bottom plate 126. Splitter plates 160 are formed in the PA-PSF duct 150. As shown in FIG. 1, the splitter plates 160 are disposed in the PA-PSF duct 150, and extend substantially parallel to corresponding surfaces defining the PA shroud top plate 124 and the PA shroud bottom plate 126, respectively.

In an exemplary embodiment, such as illustrated in FIG. 1, the splitter plates 160 are formed to have a curve. Specifically, portions of the splitter plates 160 closest to the nozzle tip outlet end 104 curve outward, e.g., away from a central inner area of the PA-PSF duct 150. More specifically, a portion of an upper splitter plate 160 curves toward the PA shroud top plate 124, while a portion of a lower splitter plate 160 curves toward the PA shroud bottom plate 126, as shown in FIG. 1. However, alternative exemplary embodiments are not limited thereto. For example, each of the splitter plates 160 may be formed to be substantially straight, e.g., rectilinear, or, alternatively, the splitter plates 160 may be formed to have a series of discrete angular, e.g., not smoothly curved, bends.

Still referring to FIG. 1, the splitter plates 160 include shear bars 170. In an exemplary embodiment, the upper splitter plate 160 includes a first shear bar 170 disposed proximate to the outlet 104 and on the portion of the upper splitter plate 160 which curves toward the PA shroud top plate 124, while the lower splitter plate 160 includes a second shear bar 170 disposed proximate to the outlet 104 and on the portion of the lower splitter plate 160 which curves toward the PA shroud bottom plate 126. Further, the first shear bar 170 is disposed on a surface of the upper splitter plate 160 which faces the PA shroud top plate 124, while the second shear bar 170 is disposed on a surface of the lower splitter plate 160 which faces the PA shroud bottom plate 126. It will be noted that alternative exemplary embodiments are not limited to the above-mentioned description, e.g., the shear bars 170 may be located at different locations on the splitter plates 160 than as shown in FIG. 1. For example, in an alternative exemplary embodiment, the shear bars 170 may be located on different, e.g., opposite, surfaces of the upper splitter plate 160 and/or the lower splitter plate 160.

A flow splitter 180 is disposed in the PA-PSF duct 150 between the splitter plates 160. In an exemplary embodiment, the flow splitter 180 is disposed approximately midway between ends of the curved portions of the splitter plates 160 (described in greater detail above). Further, the flow splitter 180 extends between the PA shroud side plates 122, as shown in FIG. 1, but alternative exemplary embodiments are not limited thereto. For example, the flow splitter 180 may not extend fully between the PA shroud side plates 122, e.g., may have length less than a distance measured between the PA shroud side plates 122. In addition, the flow splitter 180 may be located in a different area of the PA-PSF duct 150, e.g., not approximately midway between the ends of the curved portions of the splitter plates 160 in alternative exemplary embodiments. For instance, in one embodiment the flow splitter 180 may extend from one PA shroud side plate 122 to approximately the mid point of the PA shroud. Furthermore, a location of the flow splitter 180 between the edges of the splitter plates 160 may be adjusted based upon predetermined requirements of PA-PSF jets, discussed in greater detail below. For example, in an alternative exemplary embodiment, the flow splitter 180 may be disposed closer to one splitter plate 160 than another.

In an exemplary embodiment, the flow splitter 180 has a substantially triangular wedge shape in cross section, as shown in FIG. 1, but alternative exemplary embodiments are not limited thereto. Rather, the flow splitter 180 may be other shapes, such as rectangular, trapezoidal, pentagonal and other polygonal shapes, for example, or any other shape suitable for operative purposes thereof, e.g., to assist separation of an air/pulverized fuel jet into separate and discrete jets which do not recombine until after traveling a predetermined distance into a furnace, as will be described in further detail below with reference to FIG. 3. In addition, the flow splitter 180 according to an exemplary embodiment may include one or more shear bars 170 disposed thereon. Likewise, shear bars 170 may be disposed on additional surfaces such as the PA shroud side plates 122, the PA shroud top plate 124 and/or the PA shroud bottom plate 126, for example, but alternative exemplary embodiments are not limited thereto.

Referring now to FIG. 2, the sides of the SA shroud 110 and the PA shroud side plates 122 each have an aperture 190 therethrough. The apertures 190 are aligned along a common axis which serves as a pivot point 191 (best shown in FIG. 3) to allow the nozzle tip 100 to tilt up and down during operation.

Figure 3:
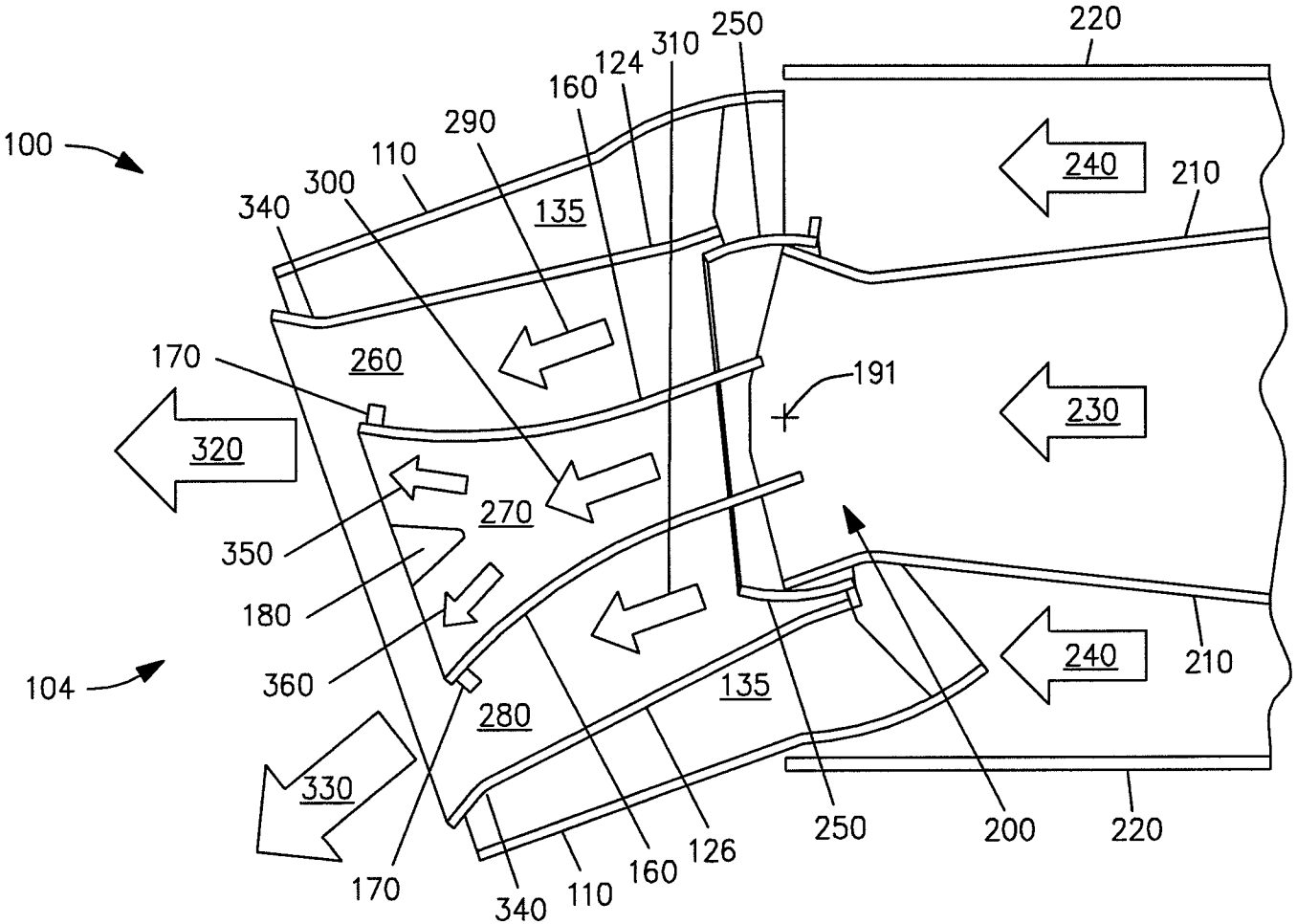
FIG. 3 is a partial cross-sectional side view showing the nozzle tip of FIGS. 1 and 2 connected to a pulverized solid fuel pipe of a pulverized solid fuel-fired furnace.

Referring now to FIG. 3, the nozzle tip 100 is mounted on a pulverized solid fuel pipe nozzle 200 of a pulverized solid fuel pipe 210 mounted within a pulverized solid fuel-air delivery conduit 220. More specifically, the pulverized solid fuel pipe nozzle 200 is attached to the aperture 190 at the nozzle tip inlet end 102 (FIG. 1) of the nozzle tip 100. The pulverized solid fuel pipe 210 delivers a fuel flow 230, e.g., a PSF-PA inlet jet 230, to the PS-PSF duct 150 through the nozzle tip inlet end 102, while secondary air 240 is delivered to the SA duct 135 of the nozzle tip 100, as shown in FIG. 3. Seal plates 250 attached to the pulverized solid fuel pipe nozzle 200 form an annular sealing shroud (not shown) which prevents the PA-PSF inlet jet 230 from entering the SA duct 135 and/or the SA 240 from entering the PA-PSF duct 150. The seal plates 250 may be omitted in an alternative exemplary embodiment.

The PA-PSF duct 150 of the nozzle tip 100 according to an exemplary embodiment is divided into three (3) chambers. Specifically, the PA-PSF duct 150 is divided into an upper PA-PSF chamber 260, a middle PA-PSF chamber 270 and a lower PA-PSF chamber 280. More specifically, the upper PA-PSF chamber 260 is defined by the PA shroud top plate 124 and an upper (with respect to FIG. 3) splitter plate 160, the middle PA-PSF chamber 270 is defined by the upper splitter plate 160 and a lower (with respect to FIG. 3) splitter plate 160, and the lower PA-PSF chamber 280 is defined by the lower splitter plate 160 and the PA shroud bottom plate 126. As described above in greater detail and illustrated in FIG. 3, the flow splitter 180 is thus disposed within the middle PA-PSF jet chamber 270, while the shear bars 170 are disposed on respective splitter plates 160 within the upper PA-PSF jet chamber 260 and the lower PA-PSF jet chamber 280, but alternative exemplary embodiments are not limited thereto. For example, the shear bars 170, or an additional shear bar 170, may be disposed within the middle PA-PSF jet chamber 270, while the flow splitter, or additional flow splitters 180, may be disposed in any or all of the upper PA-PSF jet chamber 260, the middle PA-PSF jet chamber 270 and/or the lower PA-PSF jet chamber 280.

Operation of the nozzle tip 100 will now be described in further detail with reference to FIG. 3. During operation of a pulverized solid fuel-fired furnace (not shown) having the nozzle tip 100, the PA-PSF inlet jet 230 is supplied to the PA-PSF duct 150 of the nozzle tip 100 through the pulverized solid fuel pipe 210 via the pulverized solid fuel pipe nozzle 200.

Once inside the nozzle tip 100 and, more specifically, once inside the PA-PSF duct 150 of the nozzle tip 100, the PA-PSF inlet jet 230 is divided into three (3) separate jets, e.g., an upper PA-PSF jet 290, a middle PA-PSF jet 300 and a lower PA-PSF jet 310, as shown in FIG. 3. The three (3) separate jets are formed based on the geometry, described above in greater detail, of the nozzle tip 100. More specifically, division of the PA-PSF inlet jet 230 into the three (3) separate jets is based upon physical dimensions of each of the upper PA-PSF chamber 260, the middle PA-PSF chamber 270 and the lower PA-PSF chamber 280. These physical dimensions are based on a predetermined shape and placement of the splitter plates 160 and the flow splitter 180 within the PA-PSF duct 150, for example, but are not limited thereto. As a result, an optimum division of the PA-PSF inlet jet 230 into the three (3) separate jets, e.g., the upper PA-PSF jet 290, the middle PA-PSF jet 300 and the lower PA-PSF jet 310, is obtained, based upon desired and/or actual operating conditions and characteristics of the pulverized solid fuel-fired furnace (not shown), as will be described in further detail below.

Figure 4:
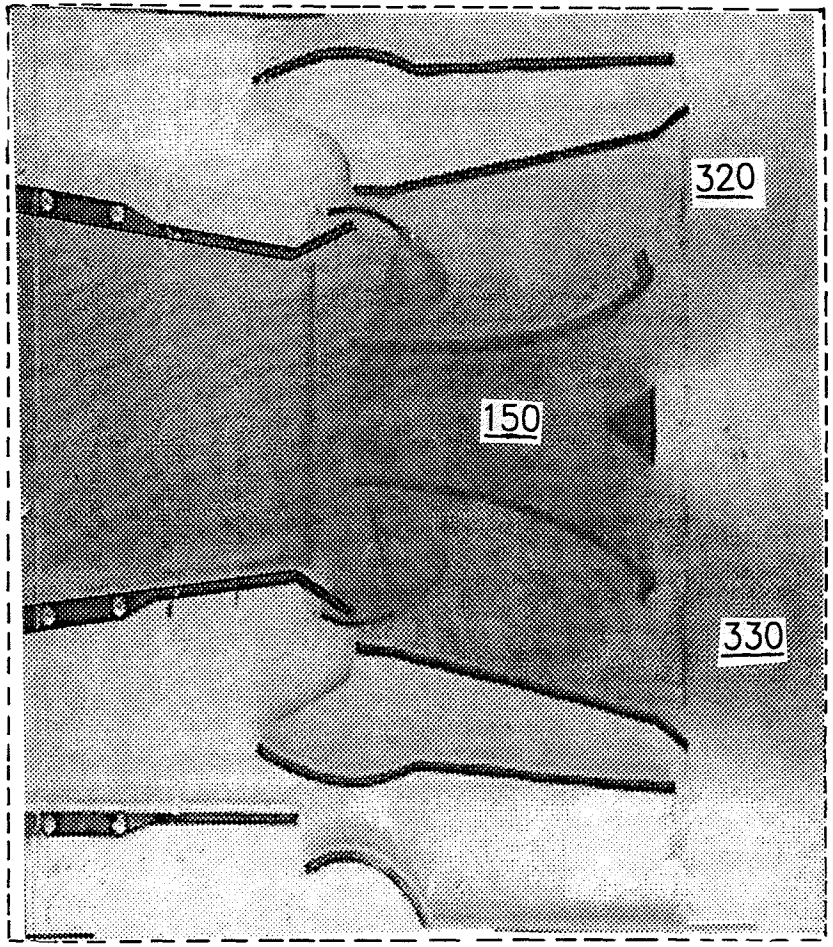
FIG. 4 is a photograph of a water table test which illustrates separate air-fuel jets exiting the nozzle tip of FIGS. 1-3.

After traversing the PA-PSF duct 150, the upper PA-PSF jet 290, the middle PA-PSF jet 300 and the lower PA-PSF jet 310 exit the nozzle tip 100 at the nozzle tip outlet end 104 into the pulverized solid fuel-fired furnace (not shown). When exiting the nozzle tip 100, the upper PA-PSF jet 290, the middle PA-PSF jet 300 and the lower PA-PSF jet 310 exit the nozzle tip 100 form two (2) separate, e.g., discrete, jets, namely an upper PA-PSF outlet jet 320 and a lower PA-PSF outlet jet 330, as shown in FIG. 3. Components within the PA-PSF duct 150, e.g., the splitter plates 160, the shear bars 170 and the flow splitter 180, as well as the arrangement of the above-mentioned components, described in greater detail above, determine formation of the upper PA-PSF outlet jet 320 and the lower PA-PSF outlet jet 330. In particular, the flow splitter 180 causes the upper PA-PSF jet 290, the middle PA-PSF jet 300 and the lower PA-PSF jet 310 to combine such that the upper PA-PSF outlet jet 320 and the lower PA-PSF outlet jet 330 exit the nozzle tip 100 as separate, discrete jets, e.g., such that the upper PA-PSF outlet jet 320 and the lower PA-PSF outlet jet 330 do not mix with each other after exiting the nozzle tip 100 and entering the pulverized solid fuel-fired furnace (not shown). More specifically, the upper PA-PSF outlet jet 320 and the lower PA-PSF outlet jet 330 remain separate and discrete for a predetermined distance after leaving the nozzle tip 100, as shown in FIG. 4. In an exemplary embodiment, the upper PA-PSF outlet jet 320 and the lower PA-PSF outlet jet 330 remain separate and discrete for a distance from the nozzle tip equal to approximately 2 to approximately 8 jet diameters of the upper PA-PSF outlet jet 320 and/or the lower PA-PSF outlet jet 330, after which the upper PA-PSF outlet jet 320 and the lower PA-PSF outlet jet 330 begin to disburse and mix with gases in the furnace, but alternative exemplary embodiments are not limited thereto. Further, after partial disbursement of the upper PA-PSF outlet jet 320 and the lower PA-PSF outlet jet 330, portions thereof, e.g., on a periphery of the upper PA-PSF outlet jet 320 and the lower PA-PSF outlet jet 330, may recirculate back towards the center flow splitter 180, thereby enhancing ignition and flame stability of the upper PA-PSF outlet jet 320 and the lower PA-PSF outlet jet 330. As a result, $NO_x$ emissions from a pulverized solid fuel-fired furnace utilizing the nozzle tip 100 according to an exemplary embodiment are substantially reduced as compared to $NO_x$ emissions from a pulverized solid fuel-fired furnace utilizing a nozzle tip of the prior art. Specifically, test results have shown that, according to one exemplary embodiment, improvements, e.g., reductions, in $NO_x$ emissions of approximately 20 percent to approximately 30 percent are obtained, due to implementation of the nozzle tip 100 (with other parameters affecting $NO_x$ emissions at equivalent levels). Depending upon the type of coal burned, further testing shows that the nozzle tip according to an exemplary embodiment reduces $NO_x$ emissions by approximately 36 percent to approximately 50 percent as compared to other known nozzle tips of the prior art.

Thus, as can be seen in FIG. 3, the flow splitter 180 divides the middle PA-PSF jet 300, into an upper portion 350 and a lower portion 360. Thus, upon exiting the nozzle tip 100, the upper portion 350 of the PA-PSF jet 300 combines with the upper PA-PSF jet 290 to form the upper PA-PSF outlet jet 320. In a similar manner, the lower portion 360 of the PA-PSF jet 300 combines with the lower PA-PSF jet 310 to form the lower PA-PSF outlet jet 330.

The physical dimensions, shape, and placement of the splitter plates 160 and the flow splitter 180 within the PA-PSF duct 150, which result in the optimum division of the PA-PSF inlet jet 230 into the three (3) separate jets (as described above), further result in optimum formation of each of the upper PA-PSF outlet jet 320 and the lower PA-PSF outlet jet 330 according to desired and/or actual operating conditions and characteristics of the pulverized solid fuel-fired furnace (not shown). For example, an initial separation distance between the upper PA-PSF outlet jet 320 and the lower PA-PSF outlet jet 330, dimensions thereof (e.g., diameters), and a distance which the upper PA-PSF outlet jet 320 and the lower PA-PSF outlet jet 330 travel after exiting the nozzle tip 100 before disbursing is determined base on the physical dimensions, shape, and placement of the splitter plates 160 and the flow splitter 180 within the PA-PSF duct 150.

Bent portions 340 on the PA shroud top plate 124 and the PA shroud bottom plate 126 near the nozzle tip outlet end 104 further prevent mixing of the upper PA-PSF outlet jet 320 and the lower PA-PSF outlet jet 330 after leaving the nozzle tip 100. In an exemplary embodiment, the bent portions 340 bend outward, e.g., away from the upper PA-PSF outlet jet 320 and the lower PA-PSF outlet jet 330 exiting the nozzle tip 100.

In an exemplary embodiment, the PA-PSF inlet jet 230 is evenly divided by the splitter plates 160 in the PA-PSF duct 150 such that the upper PA-PSF outlet jet 320 and the lower PS-PSF outlet jet 330 each include approximately 50 percent of a total flow through the nozzle tip 100, e.g., each include approximately 50 percent of the PA-PSF inlet jet 230, but alternative exemplary embodiments are not limited thereto. Further, proportions of jet flow in the upper PA-PSF chamber 260, the middle PA-PSF chamber 270 and the lower PA-PSF chamber 280 may be substantially equally divided, e.g., each having approximately ⅓ of the total flow through the nozzle tip 100. However, alternative exemplary embodiments are not limited thereto; for example, proportions of jet flow in the upper PA-PSF chamber 260, the middle PA-PSF chamber 270 and the lower PA-PSF chamber 280 may be approximately 30 percent, approximately 40 percent and approximately 30 percent, respectively.

As described above in greater detail, the upper PA-PSF outlet jet 320 and the lower PA-PSF outlet jet 330 are separate and discrete, and enter a combustion chamber of the pulverized solid fuel-fired furnace (not shown) through the nozzle tip outlet end 104 of the nozzle tip 100 as separate and discrete jets. Further, the upper PA-PSF outlet jet 320 and the lower PA-PSF outlet jet 330 remain separate and discrete in the combustion chamber. Specifically, the upper PA-PSF outlet jet 320 and the lower PA-PSF outlet jet 330 do not mix until traveling a predetermined distance after leaving the nozzle tip 100 according to an exemplary embodiment, as best shown in FIG. 4 and described above in greater detail with reference to FIG. 3.

Figure 5:
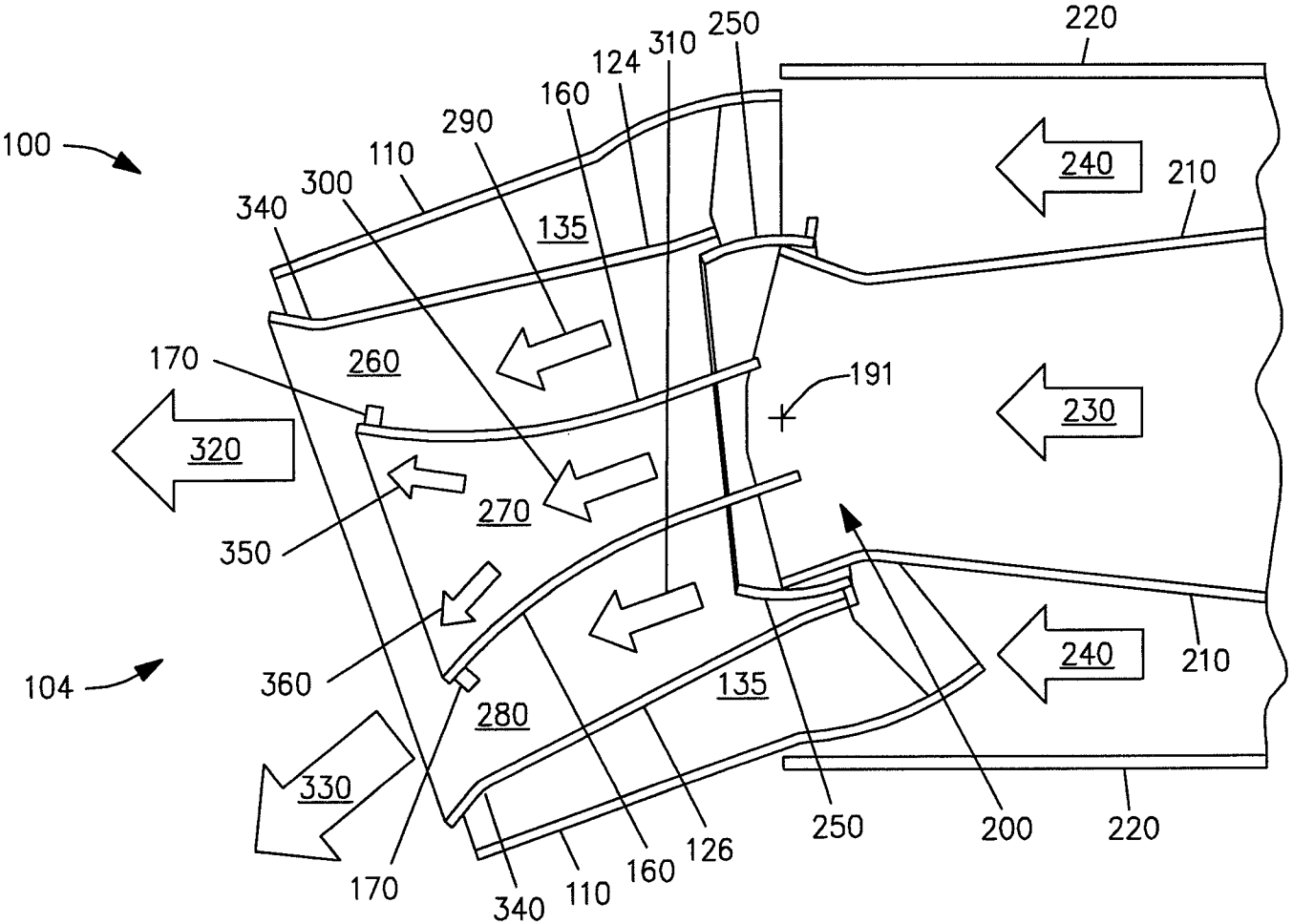
FIG. 5 is a partial cross-sectional side view showing a nozzle tip according to an alternative exemplary embodiment of the present invention.

In an alternative exemplary embodiment, the flow splitter 180 is omitted, as shown in FIG. 5. It will be noted that the same reference numerals in FIG. 5 denote the same or like components as shown in FIG. 3, and any repetitive detailed description thereof of has been omitted. Referring to FIG. 5, the middle PA-PSF jet 300 is dispersed whereby an upper portion 350 thereof combines with the upper PA-PSF jet 290 to form the upper PA-PSF outlet jet 320, and the lower portion 360 thereof combines with the lower PA-PSF jet 310 to form the lower PA-PSF outlet jet 330.

As a result of dividing the PA-PSF inlet jet 230 into separate jets, e.g., into the upper PA-PSF outlet jet 320 and the lower PS-PSF outlet jet 330, a low pressure area is formed in a region substantially between the upper PA-PSF outlet jet 320 and the lower PS-PSF outlet jet 330, relative to pressures of other areas substantially adjacent to (or even within) each of the upper PA-PSF outlet jet 320 and the lower PS-PSF outlet jet 330. Thus, the low pressure area substantially between the upper PA-PSF outlet jet 320 and the lower PS-PSF outlet jet 330 provides a low resistance path to permit a combustion flame to ignite the fuel (e.g., coal particles) disposed within the inner portion of the outlet fuel jet, thereby consuming oxygen therein. As a result, oxygen in the low pressure region is effectively depleted, resulting in less oxygen available for $NO_x$ formation, thereby substantially decreasing $NO_x$ emissions from a pulverized solid fuel-fired boiler having the nozzle tip according to an exemplary embodiment. Specifically, computational fluid dynamics modeling and combustion testing of a nozzle tip according to an exemplary embodiment suggest that concentrating the coal particles towards the outside of the coal stream is advantageous for reducing NOx emissions while minimizing unburned carbon levels. One will appreciate that this embodiment shown and described hereinbefore in FIGS. 1-3 having a flow splitter 180 provides a similar low pressure area disposed at the an outer surface of the flow splitter.

Dividing the PA-PSF inlet jet 230 into separate and discrete jets, e.g., into the upper PA-PSF outlet jet 320 and the lower PS-PSF outlet jet 330, results in a low pressure area in a region substantially between the upper PA-PSF outlet jet 320 and the lower PS-PSF outlet jet 330, relative to pressures of other areas substantially adjacent to (or even within) each of the upper PA-PSF outlet jet 320 and the lower PS-PSF outlet jet 330. Thus, the low pressure area substantially between the upper PA-PSF outlet jet 320 and the lower PS-PSF outlet jet 330 results in a combustion flame being drawn to the low pressure area, thereby consuming oxygen therein. As a result, oxygen in the low pressure region is effectively depleted, resulting in less oxygen available for $NO_x$ formation, thereby substantially decreasing $NO_x$ emissions from a pulverized solid fuel-fired boiler having the nozzle tip according to an exemplary embodiment.

In addition, dividing the PA-P SF inlet jet 230 into the separate and discrete jets, e.g., into the upper PA-PSF outlet jet 320 and the lower PS-PSF outlet jet 330, further results in each of the separate and discrete jets having a decreased diameter relative to a diameter of the upper PA-PSF outlet jet 320. More specifically, assuming a cross-sectional surface area A of the PA-PSF inlet jet 230 having a diameter a diameter D, the upper PA-PSF outlet jet 320 and the lower PS-PSF outlet jet 330 each have a diameter $D_1=D/\sqrt{2}$ (given that a summed cross-sectional surface area of an area of the upper PA-PSF outlet jet 320 and an area of the lower PS-PSF outlet jet 330 is equal to A). Thus, jet penetration for the separate and discrete jets (compared to a single jet of equivalent area) decreases while jet dispersion thereof increases, since jet penetration is directly proportional to jet diameter and jet dispersion is indirectly proportional to jet diameter.

Furthermore, a total wetted perimeter $P_T$ of the two separate and discrete jets having the diameter $D_1$ is substantially increased or effectively improved as compared to a wetted perimeter P of a single jet, e.g., the PA-PSF inlet jet 230 having the cross-sectional area A. Specifically, the upper PA-PSF outlet jet 320 and the lower PS-PSF outlet jet 330, each having the diameter $D_1=D/\sqrt{2}$ combine to yield a resultant total wetted perimeter $P_T=2(2*\pi*(D_1/2))=\sqrt{2}*P$. As a result, jet dispersion, e.g., jet breakdown, is further increased. The increased total wetted perimeter of the separate and distinct jets allows for controlled amounts of air available at a near field of combustion in the combustion chamber to mix with pulverized solid fuel, thereby improving early flame stabilization and devolatilization. The increased total wetted perimeter also allows for improved mixing and recirculation of hot products of combustion over a greater area of the fuel jet, also resulting in improved early flame stabilization and early devolatilization of the fuel and/or fuel-bound nitrogen in an oxygen-limited, fuel-rich substoichiometric region of a near field of a region downstream of the nozzle tip 100.

Thus, the nozzle tip 100 according to exemplary embodiments described herein provides at least the advantages of decreased primary air/pulverized fuel jet penetration and increased primary air/pulverized fuel jet surface area, wetted area and dispersion, thereby enhancing early ignition, early flame stabilization, fuel devolatilization and early fuel bound nitrogen release. As a result, $NO_X$ emissions from a pulverized solid fuel-fired boiler having the nozzle tip in accordance with an exemplary embodiment of the present invention are substantially decreased or effectively reduced. The aforementioned advantages are apparent when implementing the nozzle tip according to an exemplary embodiment in a boiler designed to have reduced main burner zone ("MBZ") stoichiometry, e.g., in a staged combustion environment in which it is desirable to initiate combustion closer to the nozzle tip (as compared to boilers having a high MBZ stoichiometry), but alternative exemplary embodiments are not limited thereto.

Figure 6:
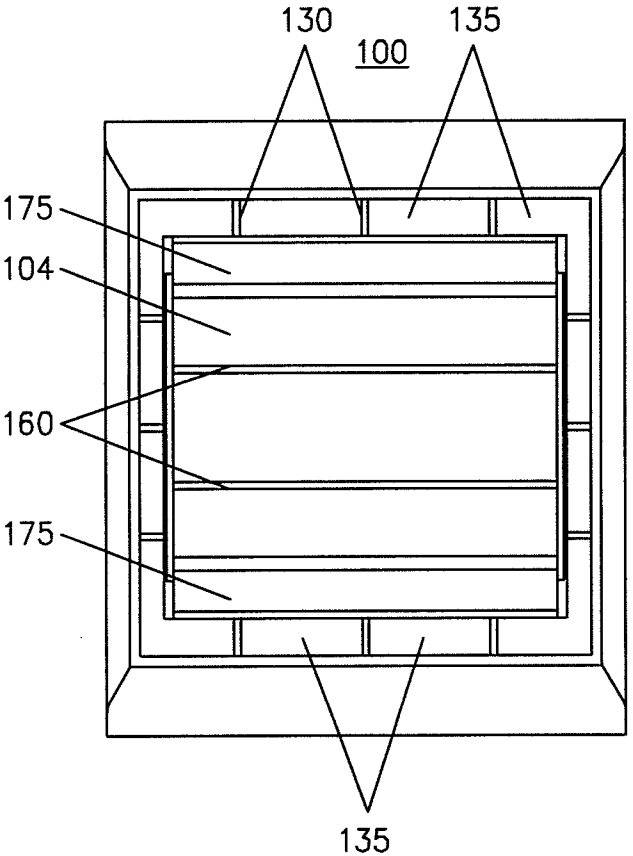
FIG. 6 is a plan view from the outlet side of an alternative embodiment of the nozzle tip of the present invention employing air deflectors.

FIG. 6 is a plan view from the outlet side of an alternative embodiment of the nozzle tip of the present invention employing air deflectors. This embodiment is similar to that of FIG. 5, with the exceptions that splitter plates 160 do not diverge, shear bars 170 are not employed and air deflectors 175 are added as shown.

Figure 7:
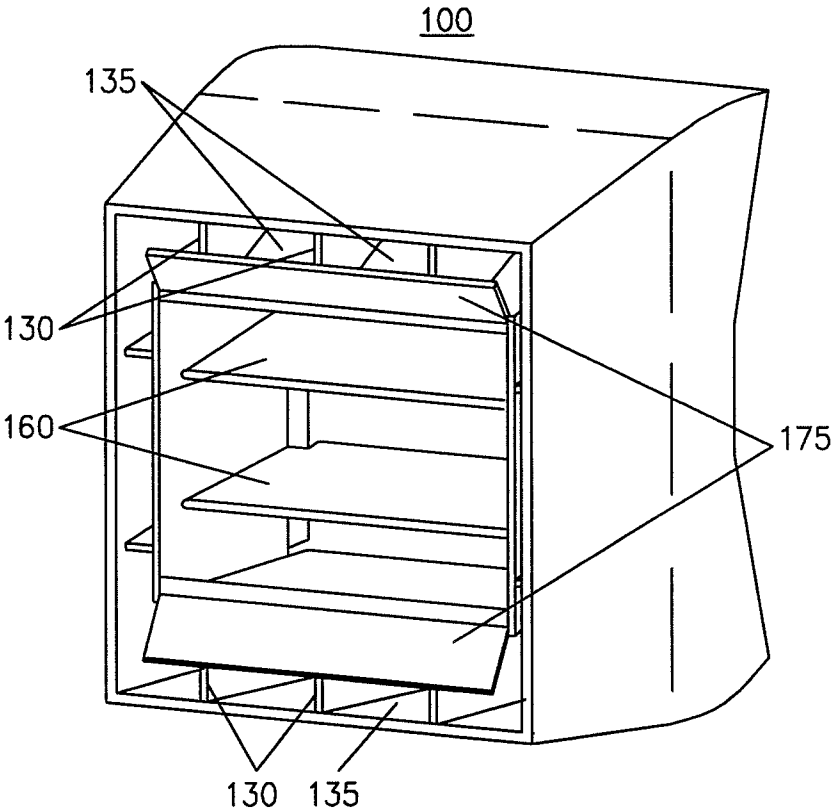
FIG. 7 is a rear perspective view of the nozzle tip of FIG. 6.

FIG. 7 is a rear perspective view of the nozzle tip of FIG. 6. Here splitter plates 160 are shown as well as the air deflectors 175.

Figure 8:
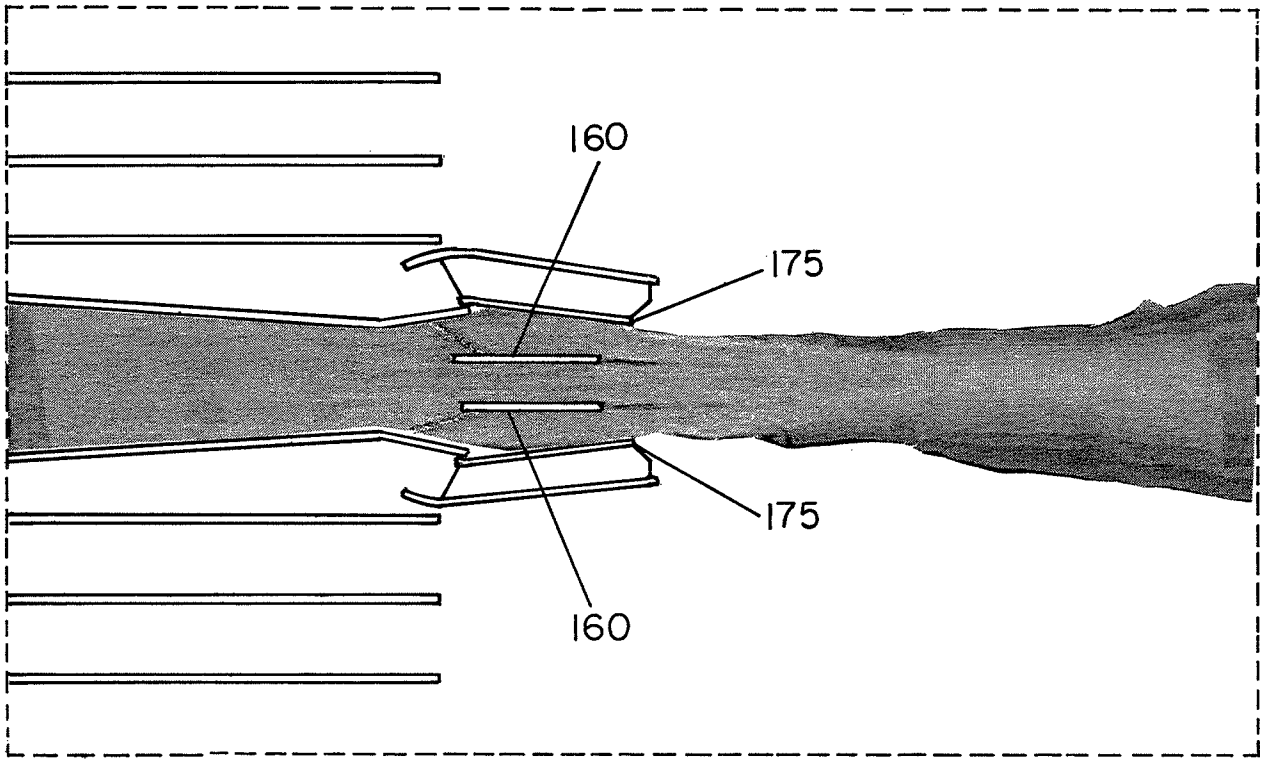
FIG. 8 is a computer-generated simulation showing the predicted particle flow concentration for the nozzle tip of FIGS. 6 and 7.

FIG. 8 is a computer-generated simulation showing the predicted particle concentration for the nozzle tip of FIGS. 6 and 7. In this, and all following simulations, a computer model was generates using applicable conditions to predict how the particles were concentrated after they had passed through the nozzle. These simulations are important in designing a low NOx nozzle.

No simulation data was generated for the areas in white. In this case, it was the air passing through the secondary air nozzle 135.

Figure 10:
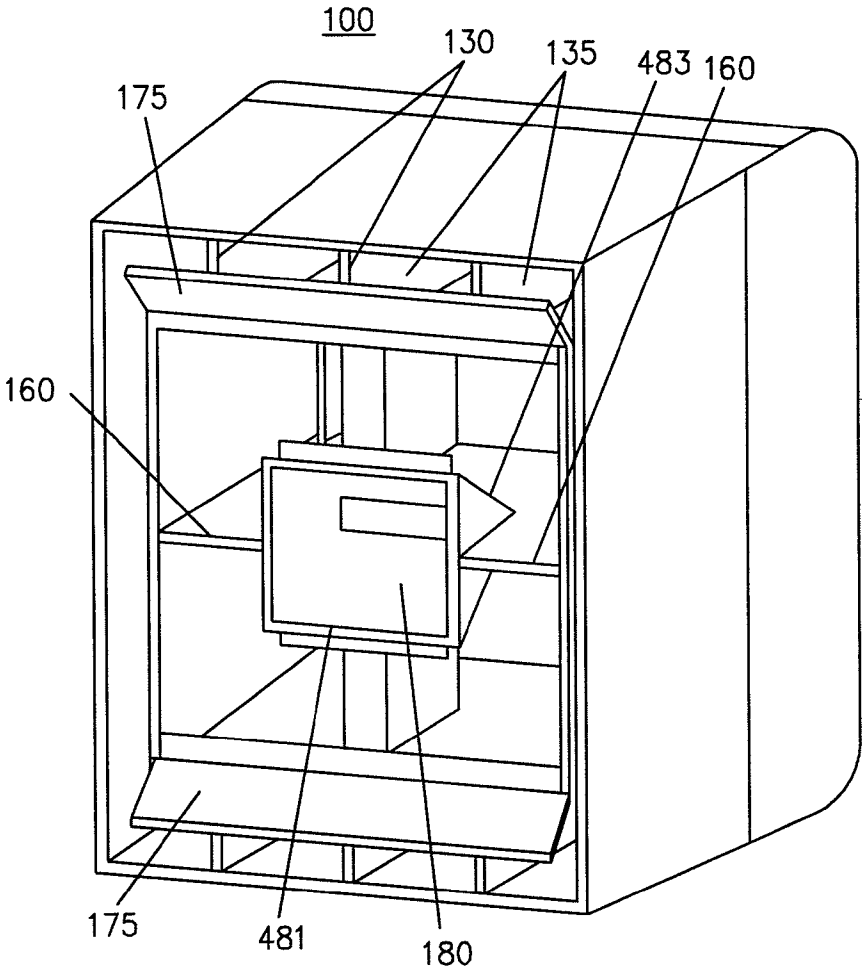
FIG. 10 is a rear perspective view of the nozzle tip of FIG. 9.
Figure 9:
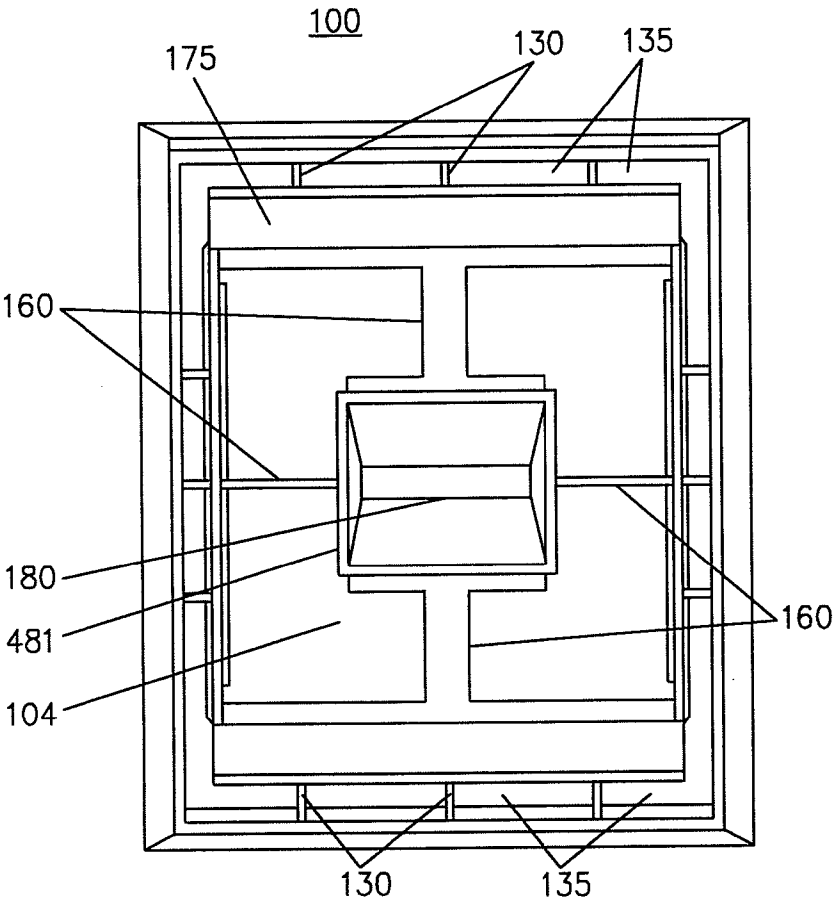
FIG. 9 is a plan view from the outlet side of an alternative embodiment of the nozzle tip of the present invention employing a center bluff.

FIG. 9 is a plan view from the outlet side of an alternative embodiment of the nozzle tip of the present invention employing a center bluff. FIG. 10 is a rear perspective view of the nozzle tip of FIG. 9. This embodiment will be described with reference to both FIGS. 9 and 10.

A splitter plate 160 is positioned through the center of outlet 104 in both a vertical direction and a horizontal direction. Here the flow splitter 180 having a wedge shape having a base 483 and an apex edge 481. Flow splitter 180 is positioned at the center relative to the vertical and horizontal directions. It is also placed at the rear of the nozzle 100, flush with the outlet 104. This embodiment also includes air deflectors 175.

Figure 11:
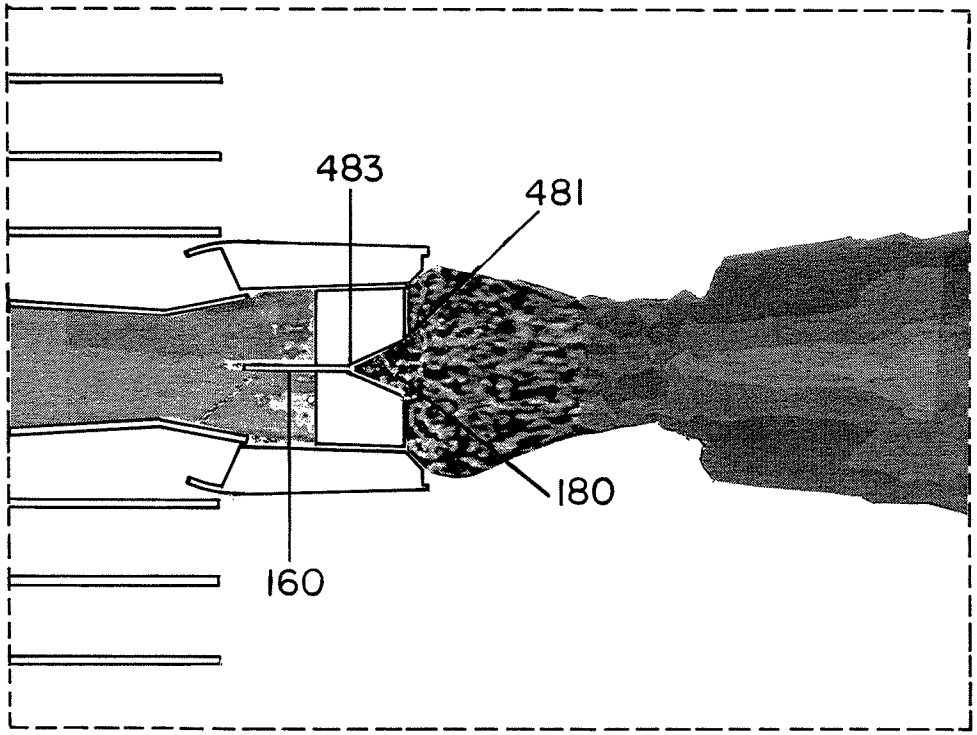
FIG. 11 is a computer-generated simulation showing the predicted particle flow concentration for the nozzle tip of FIGS. 9 and 10.

FIG. 11 is a computer-generated simulation showing the predicted particle flow concentration for the nozzle tip of FIGS. 9 and 10. There is a pattern of particle distribution to downstream from the nozzle. Since flow splitter 180 has a hollow base 181, particles are allowed to recirculate into flow splitter 180.

Figure 13:
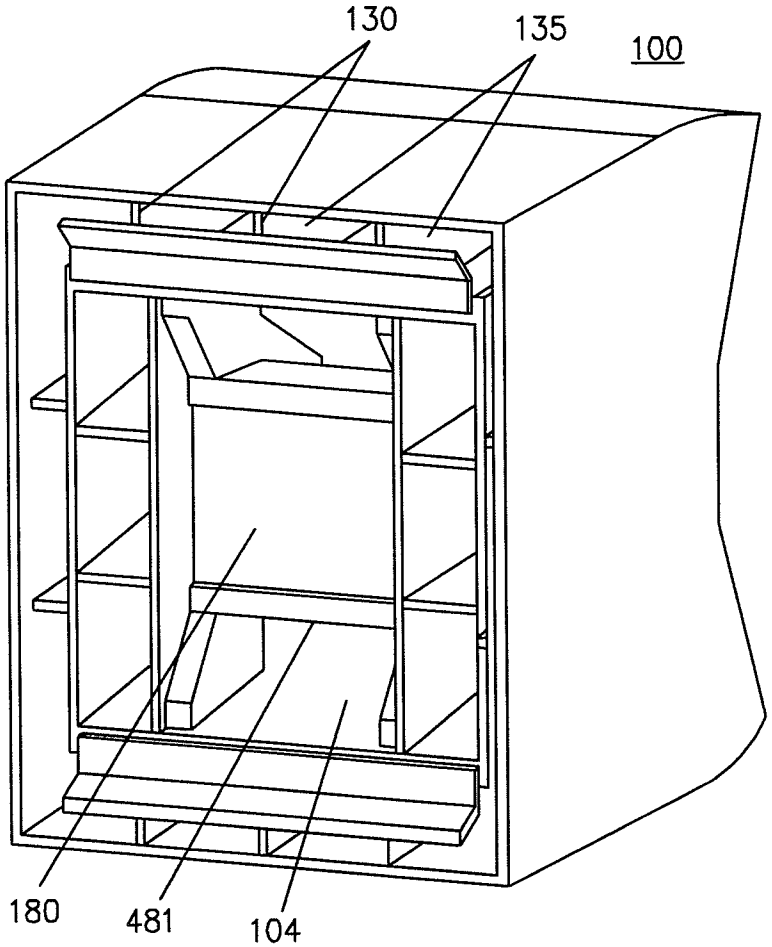
FIG. 13 is a rear perspective view of the nozzle tip of FIG. 12.
Figure 12:
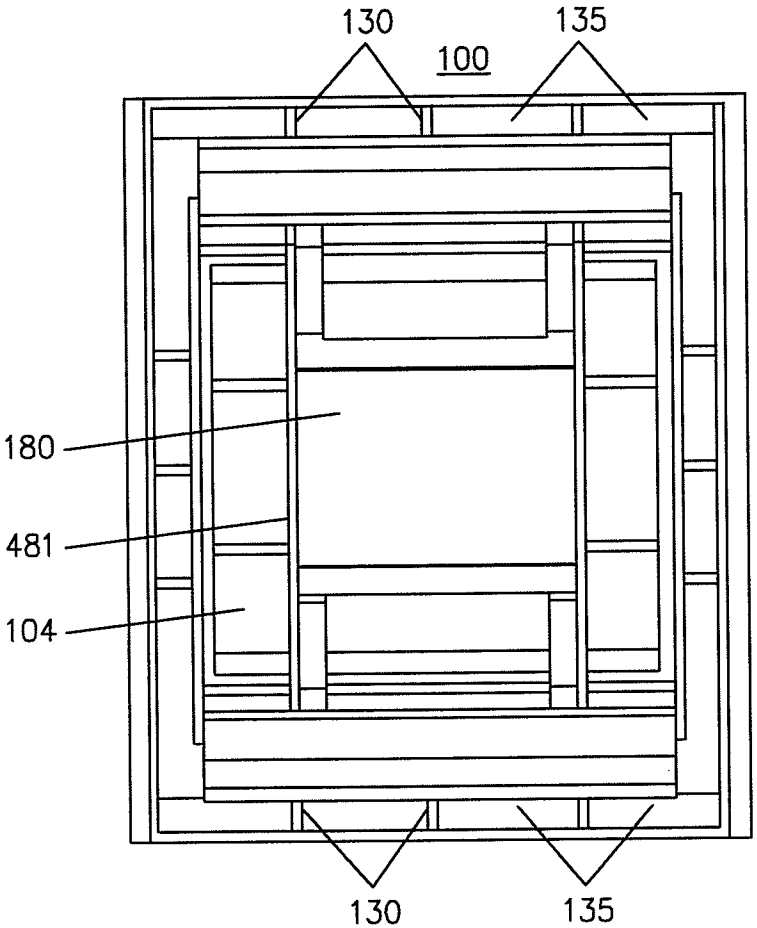
FIG. 12 is a plan view from the outlet side of an alternative embodiment of the nozzle tip of the present invention employing a recessed center bluff.

FIG. 12 is a plan view from the outlet side of an alternative embodiment of the nozzle tip of the present invention employing a recessed center bluff. FIG. 13 is a rear perspective view of the nozzle tip of FIG. 12. The elements of this embodiment will be described in connection with both FIGS. 12 and 13.

This embodiment includes multiple splitter plates 160 oriented in both the vertical and horizontal directions. Flow splitter 180 is enclosed with a flat base 481. The flow splitter 180 0 is offset, or recessed inward away from the outlet 104 edge as compared with the flow splitter of FIGS. 9 and 10.

Figure 14:
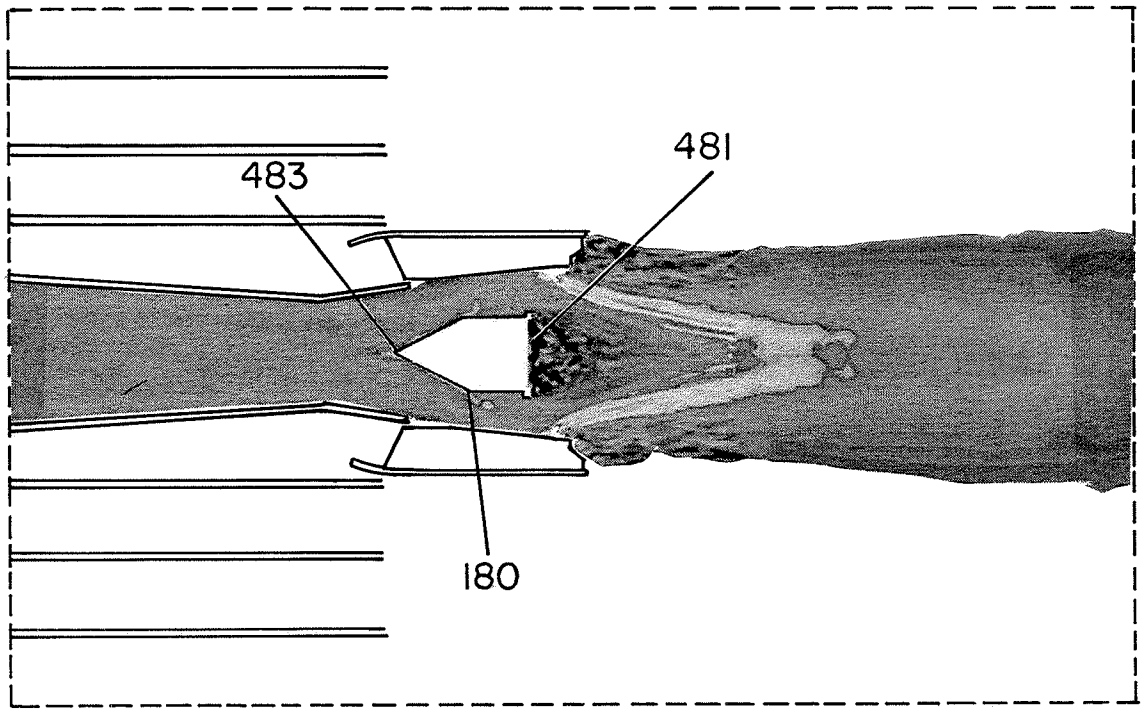
FIG. 14 is a computer-generated simulation showing the predicted particle flow concentration for the nozzle tip of FIGS. 12 and 13.

FIG. 14 is a computer-generated simulation showing the predicted particle flow concentration for the nozzle tip of FIGS. 12 and 13. The apex edge 483 of the flow splitter cuts through the oncoming flow of particles and splits the flow into a flow above and below the flow splitter 180. There is a turbulent zone immediately downstream from the base 481 of flow splitter 180.

Figure 16:
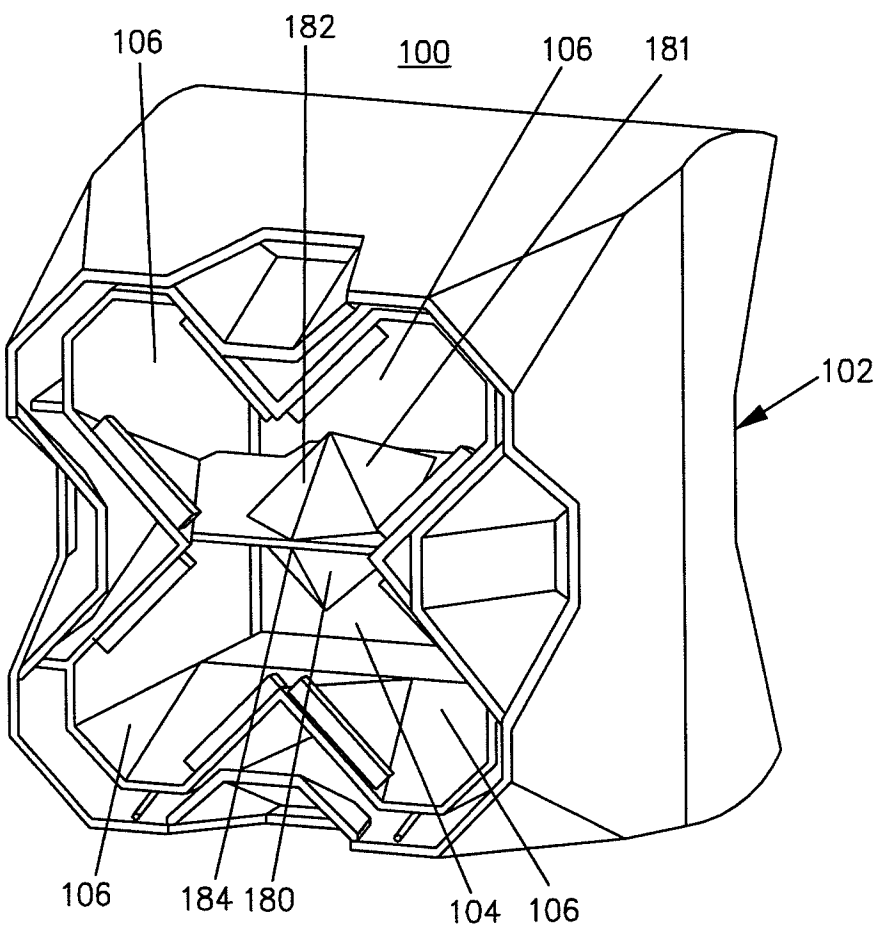
FIG. 16 is a rear perspective view of the nozzle tip of FIG. 15.
Figure 15:
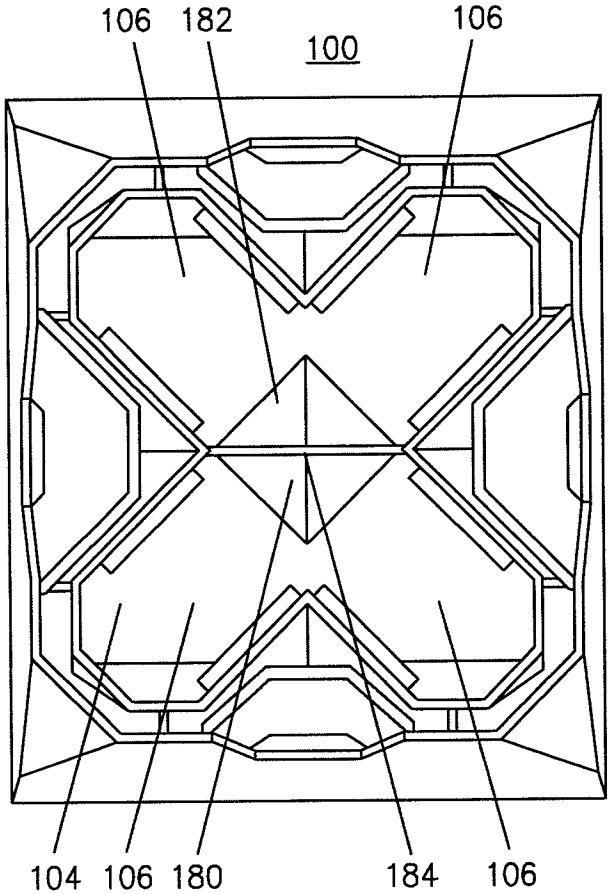
FIG. 15 is a plan view from the outlet side of an "X"-shaped nozzle tip being an alternative embodiment of and of the present invention.

FIG. 15 is a plan view from the outlet side of an "X"-shaped nozzle tip being an alternative embodiment of and of the present invention. FIG. 16 is a rear perspective view of the nozzle tip of FIG. 15. This embodiment will be described in connection with both FIGS. 15 and 16.

Outlet 104 has a general "X" shape, with the outlet 104 extending outward from a central location 108, into 4 outlet lobes 106 of outlet 104. Even though 4 lobes are shown here, any number of lobes radiating from the central location 108 envisioned by this invention.

A flow splitter 180 is positioned on a splitter plate 160 oriented horizontal across the nozzle 100 approximately evenly bisecting outlet 104 into an upper half and a lower half.

The flow splitter 180 has a leading section 181 and a trailing section 182 both inclines toward a center of the flow splitter both along its length and width. The leading section 181 has a 4-sided pyramid shape with a leading apex 183 and a base (not shown).

The trailing section [182] also is shaped like a 4-sided pyramid having an apex 184 and a base (not shown). In this embodiment, the bases of the pyramids are together with the apices pointing away from each other.

Each side of the leading section 181 of the flow splitter 180 are positioned, sized and angled to deflect incident flow toward its nearest outlet lobe 105. This effectively splits the flow into 4 components, one for each outlet lobe 106.

Figure 17:
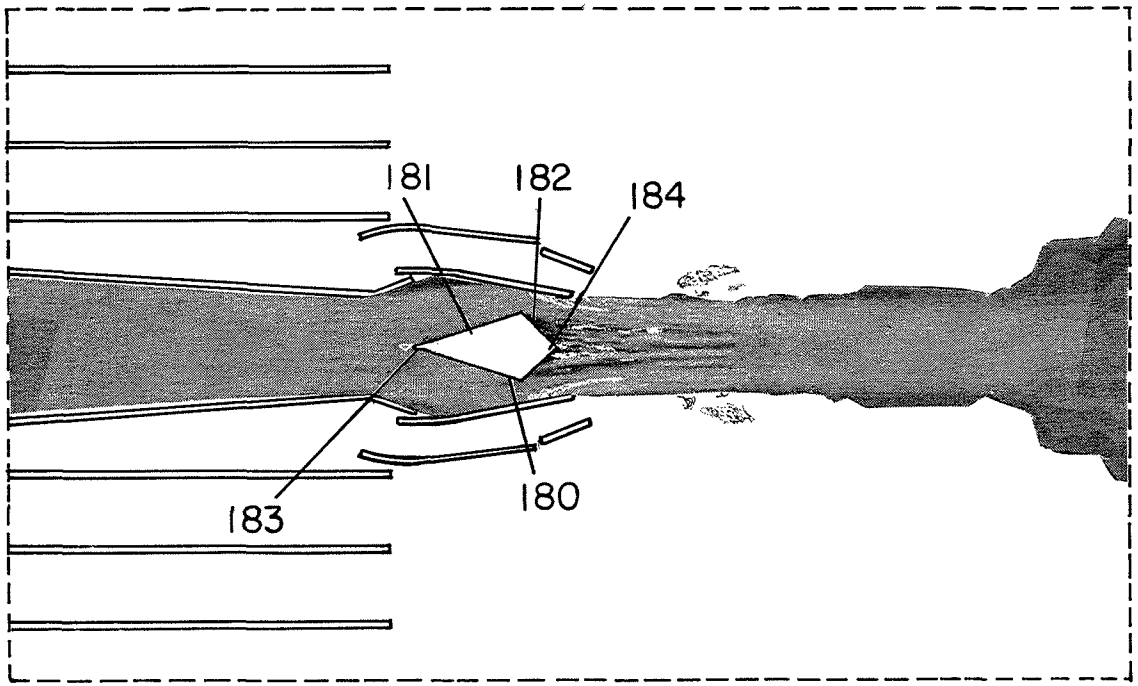
FIG. 17 is a computer-generated simulation showing the predicted particle flow concentration for the nozzle tip of FIGS. 15 and 16.

FIG. 17 is a computer-generated simulation showing the predicted particle flow concentration for the nozzle tip of FIGS. 15 and 16. The cross sectional shape of flow splitter 180 can be seen in this figure. Leading section 181 here appears having a triangular cross-sectional shape. Trailing section 182 also has a cross sectional shape. The apex 183 of leading section 181 is visible as is apex 184 of the trailing section 182.

In an alternative embodiment, only a leading section 181 is used for the flow splitter 180. This may have a flat base, or be hollow.

Figure 19:
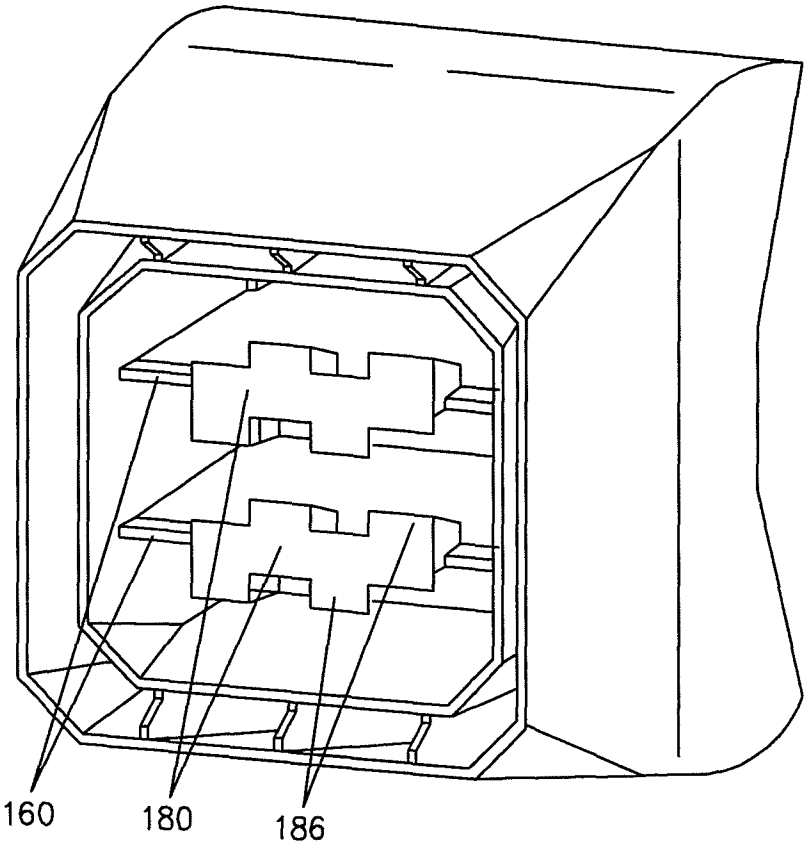
FIG. 19 is a rear perspective view of the nozzle tip of FIG. 18.
Figure 18:
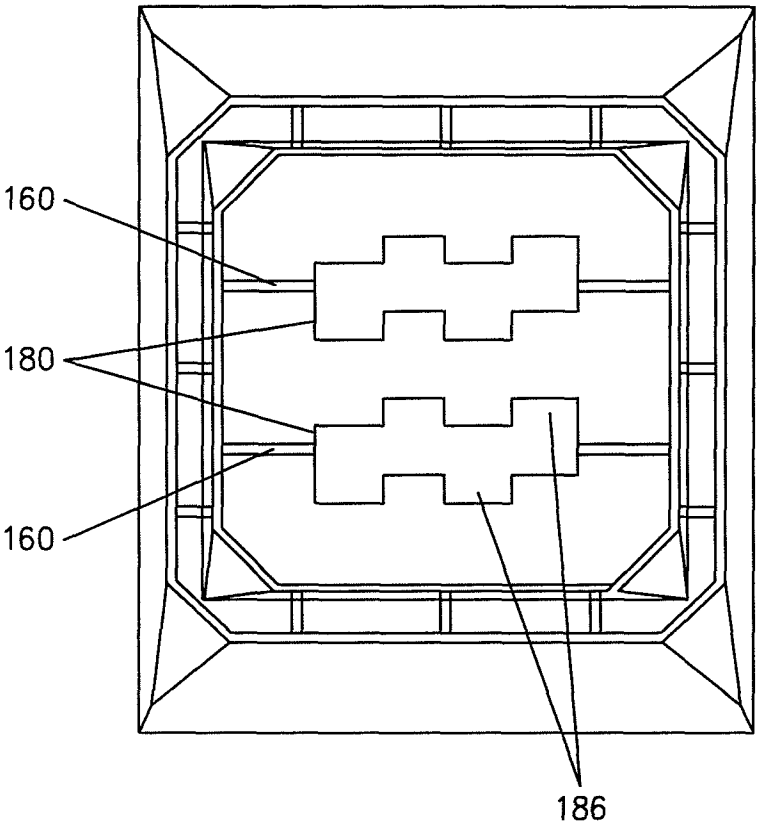
FIG. 18 is a plan view from the outlet side of a nozzle tip employing a flow splitter with diffuser blocks according to another embodiment of the present invention.

FIG. 18 is a plan view from the outlet side of a nozzle tip employing a flow splitter with diffuser blocks. FIG. 19 is a rear perspective view of the nozzle tip of FIG. 18. These embodiments are the subject of U.S. Pat. No. 6,439,136 B1 issued Aug. 27, 2002 to Jeffrey S. Mann and Ronald H. Nowak, hereby incorporated by reference as if set forth in its entirety herein. A full description of this embodiment is presented in this application.

Here the flow splitter 180 employs several diffusion blocks adjacent to each other on alternating sides of splitter plate 160.

Figure 20:
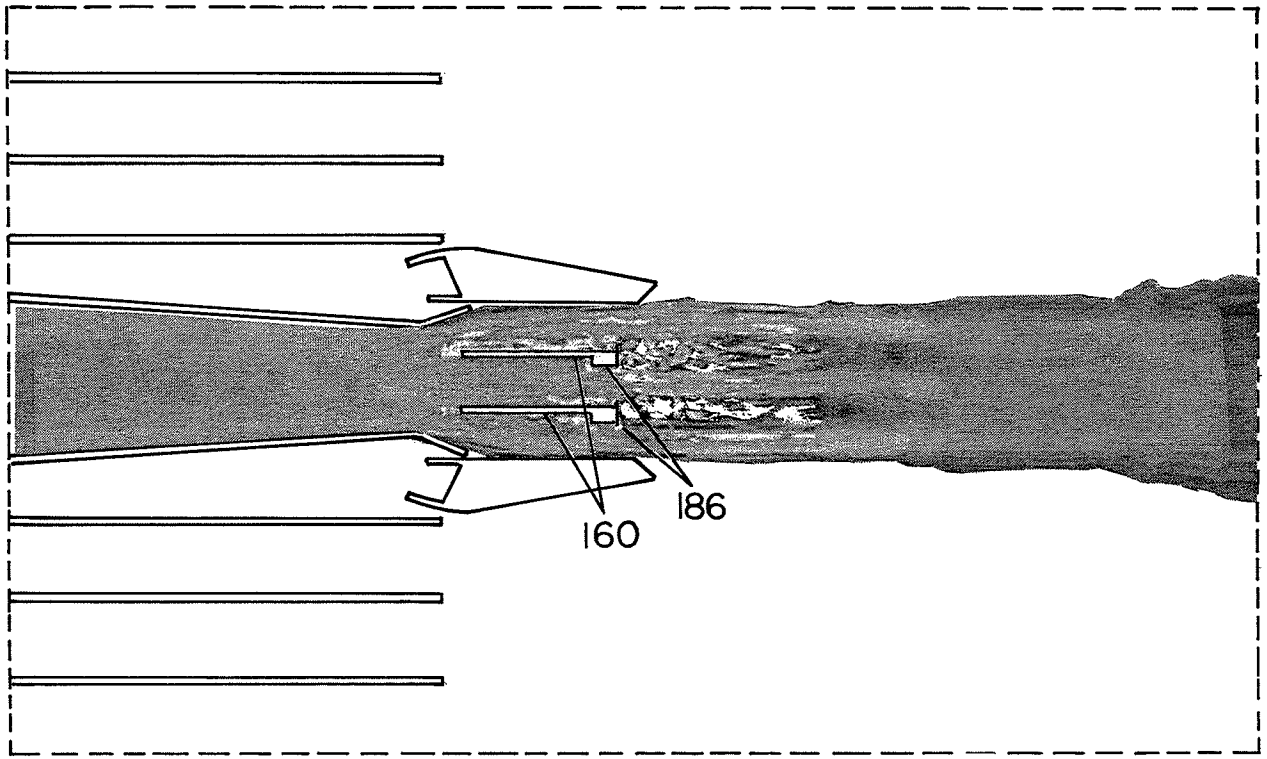
FIG. 20 is a computer-generated simulation showing the predicted particle flow concentration for the nozzle tip of FIGS. 18 and 19.

FIG. 20 is a computer-generated simulation showing the predicted particle flow concentration for the nozzle tip of FIGS. 18 and 19. This shows the cross-sectional shape of the nozzle. The diffusion blocks 186 attached to the splitter plates 160 can be seen in cross section.

Figure 22:
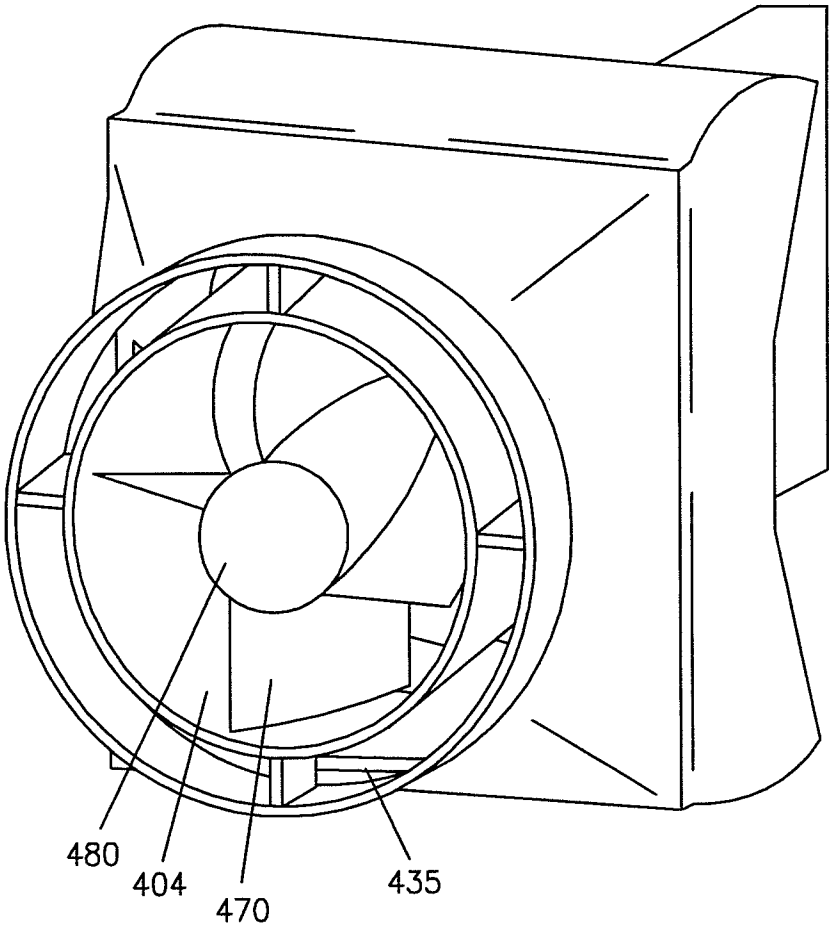
FIG. 22 is a rear perspective view of the nozzle tip of FIG. 21.
Figure 21:
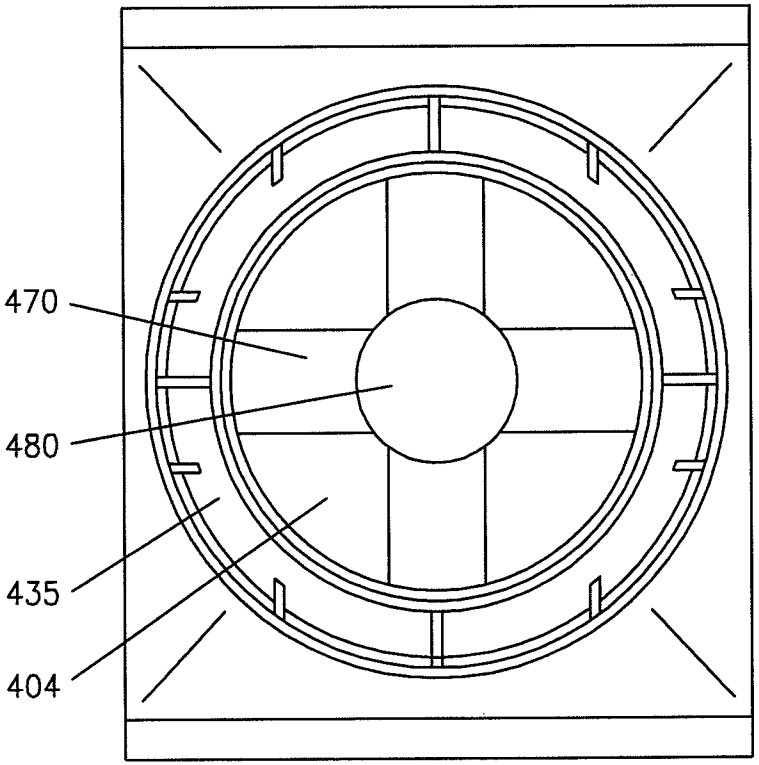
FIG. 21 is a plan view from the outlet side of a round coal nozzle tip according to another embodiment of the present invention.

FIG. 21 is a plan view from the outlet side of a round coal nozzle tip. FIG. 22 is a rear perspective view of the nozzle tip of FIG. 21. This, and related embodiments are the subject of pending U.S. patent Ser. No. 11/279,123 filed Apr. 10, 2006 entitled "Pulverized Solid Fuel Nozzle" by Oliver G. Biggs, Jr., Kevin E. Connolly, Kevin A. Greco, Philip H Lafave and Galen H. Richards (the "Round Nozzle Tip Application") hereby incorporated by reference as if set forth in its entirety herein. A full description of this embodiment is presented in this application.

A circular outlet 408 houses a rotor 470 on a rotor hub 480. An annular air duct 435 encircles the circular outlet 408.

Figure 23:
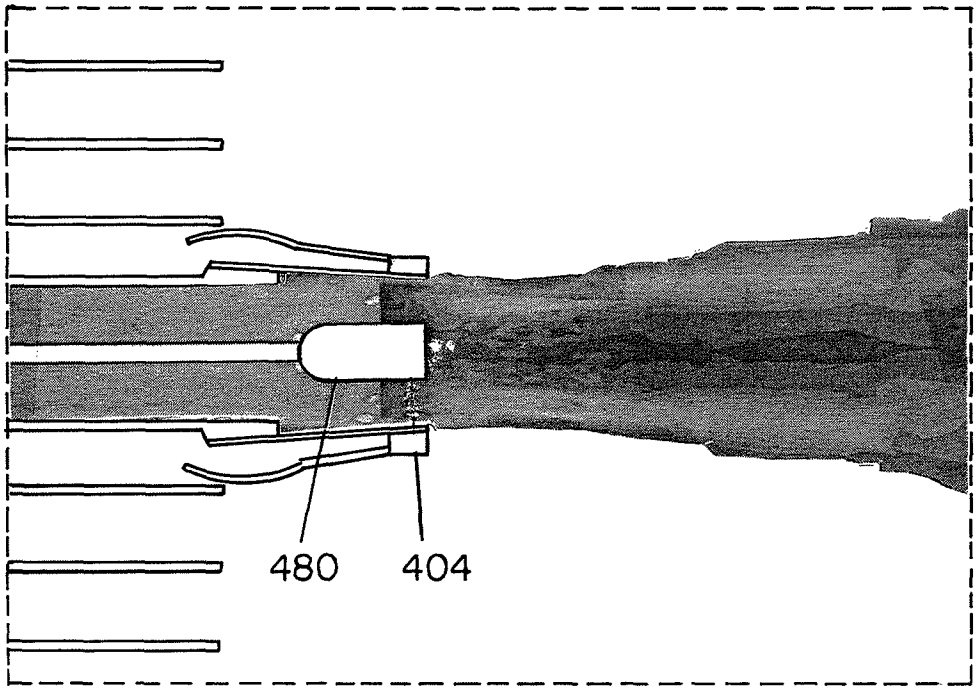
FIG. 23 is a computer-generated simulation showing the predicted particle concentration for the nozzle tip of FIGS. 21 and 22.

FIG. 23 is a computer-generated simulation showing the predicted particle flow concentration for the nozzle tip of FIGS. 21 and 22. This shows it's cross sectional structure. Rotor hub 480 mixes the particles as they pass through the rotor and out of outlet 404.

Figure 25:
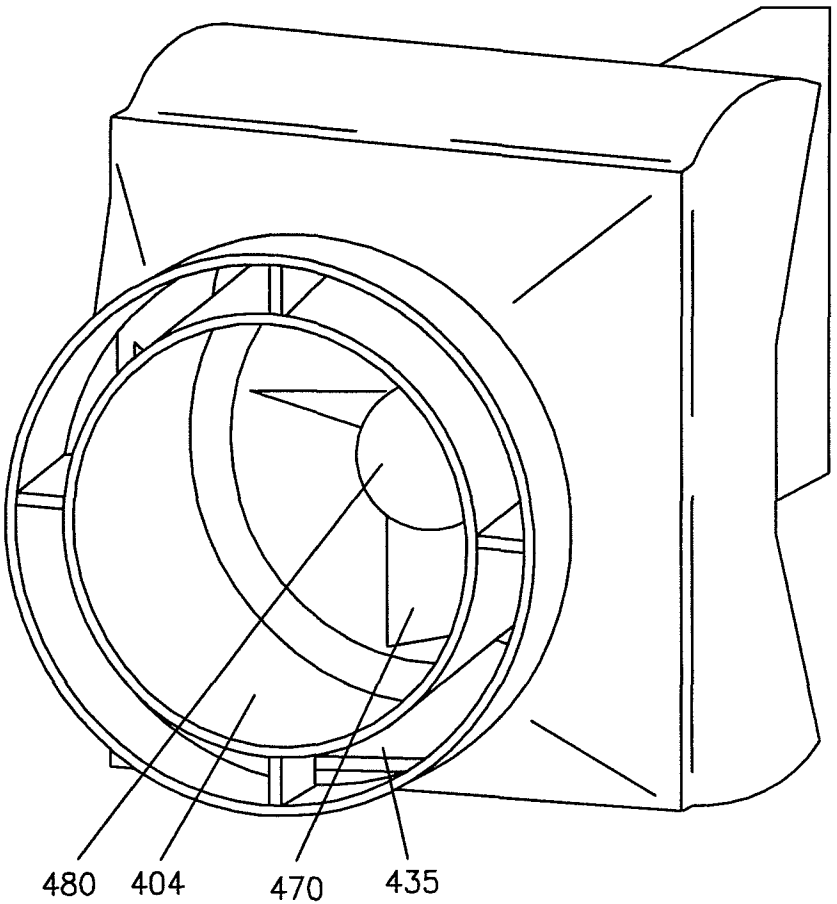
FIG. 25 is a rear perspective view of the nozzle tip of FIG. 24.
Figure 24:
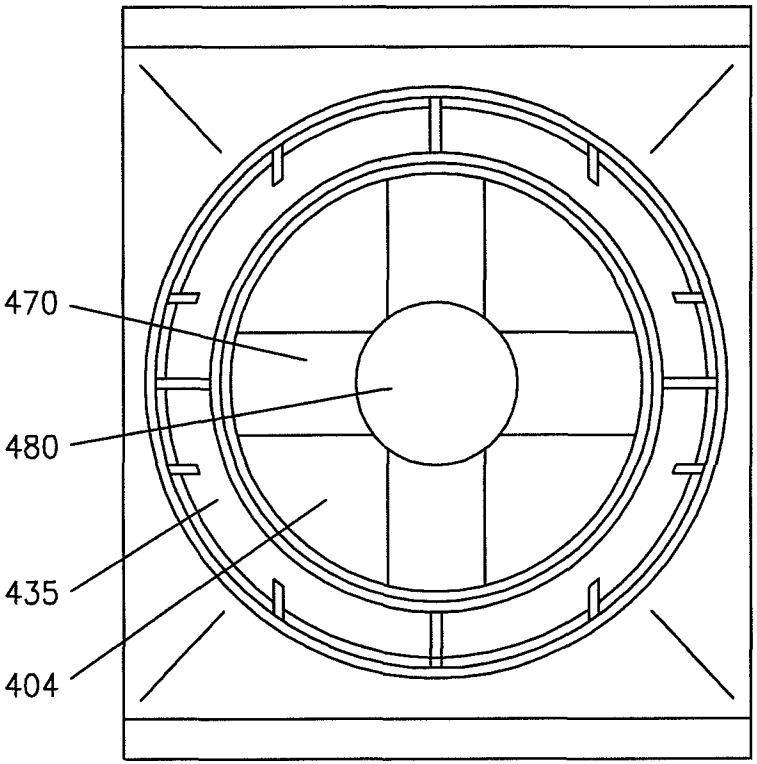
FIG. 24 is a plan view from the outlet side of a round coal nozzle tip with a recessed swirler in accordance with another embodiment of the present invention.

FIG. 24 is a plan view from the outlet side of a round coal nozzle tip with a recessed swirler. FIG. 25 is a rear perspective view of the nozzle tip of FIG. 24. This is similar to the Round Nozzle Tip Application above.

These figures show a similar structure to that FIGS. 21-22, except that the rotor 470 is recessed within the nozzle.

Figure 26:
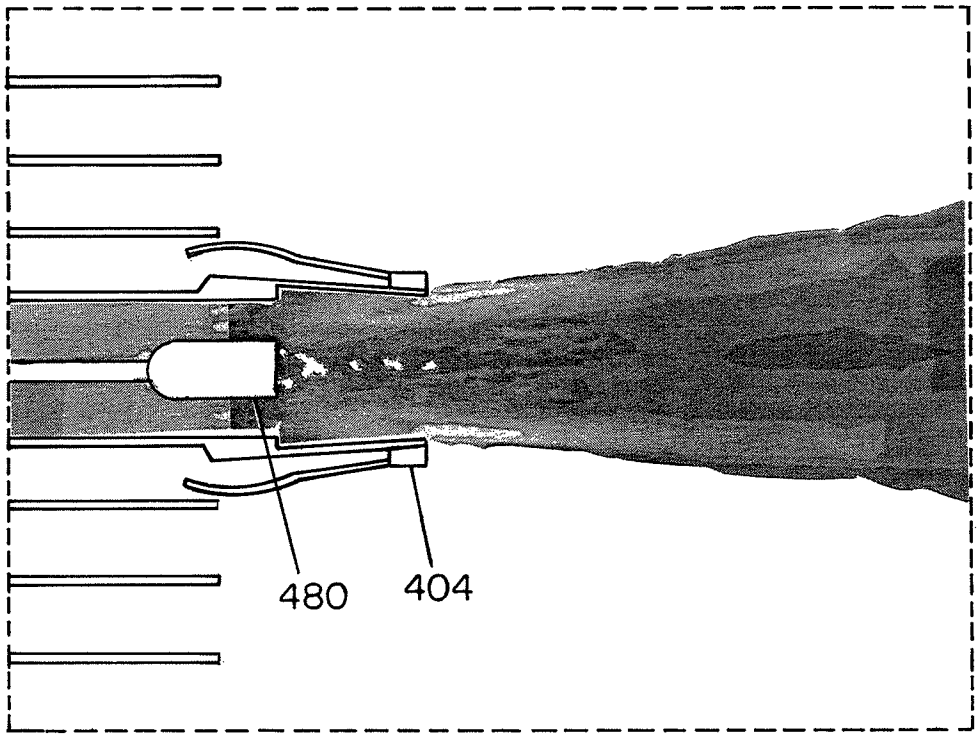
FIG. 26 is a computer-generated simulation showing the predicted particle concentration for the nozzle tip of FIGS. 24 and 25.

FIG. 26 is a computer-generated simulation showing the predicted particle flow concentration for the nozzle tip of FIGS. 24 and 25. This shows it's cross sectional structure. Rotor hub 480 and outlet 408 are visible in this view.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle tip for a pulverized solid fuel pipe nozzle of a pulverized solid fuel-fired furnace that reduces NOx emissions, the nozzle tip comprising:

a primary air shroud having an inlet and an outlet , wherein the inlet receives a fuel flow;

a first splitter plate having a flow splitter positioned generally in the center of, and separated from the primary air shroud, the flow splitter having a wedge shape with an apex edge and a base, the apex edge positioned closer to the inlet and the base positioned closer to the outlet, the flow splitter extending only partially across the outlet, the flow splitter creating turbulence in the fuel flow that disperses the fuel flow as the fuel flow passes by the flow splitter and out of outlet, wherein the base extends on opposing sides of the first splitter plate in the center.

2. The nozzle tip of claim 1, further comprising at least one of a shear bar and a bluff point disposed on the first splitter plate.

3. The nozzle tip of claim 1, further comprising an air deflector disposed on the primary air shroud.

4. The nozzle tip of claim 1 wherein the first splitter plate is positioned in a substantially vertical direction.

5. The nozzle tip of claim 1 wherein the first splitter plate is positioned in a substantially horizontal direction.

6. The nozzle tip of claim 1 wherein the flow splitter is positioned between the inlet and the outlet and its base is recessed with respect to the outlet.

7. A nozzle tip for a pulverized solid fuel pipe nozzle of a pulverized solid fuel-fired furnace that reduces NOx emissions, the nozzle tip comprising:

a primary air shroud having an inlet and an outlet, wherein:

the inlet receives solid fuel particles suspended in an airflow stream as a fuel flow, the outlet generally has a cross-sectional shape with a plurality of lobes each radiating from a central location;

a flow splitter disposed within the primary air shroud substantially at the central location, the flow splitter functioning to deflect solid particles of the fuel flow into each lobe of the output and disperse the particles within the lobes allowing for combustion of the fuel flow with reduced NOx emissions.

8. The nozzle tip of claim 7 further comprising:

a splitter plate [160] disposed within the primary shroud for supporting the flow splitter.

9. A nozzle tip for a pulverized solid fuel pipe nozzle of a pulverized solid fuel-fired furnace that reduces NOx emissions, the nozzle tip comprising:

a primary air shroud having an inlet and an outlet, wherein the inlet receives a fuel flow;

a first splitter plate disposed within the primary air shroud, the first splitter plate and the primary air shroud defining a duct for receiving a first portion of the fuel flow; and a second splitter plate disposed within the primary air shroud, the second splitter plate and the primary air shroud defining a duct for receiving a second portion of the fuel flow, wherein the first splitter plate, the second splitter plate, and the primary air shroud define a duct for receiving a third portion of the fuel flow disposed intermediate to the first portion and the second portion of the fuel flow, the third portion of the fuel flow comprising a first split flow and a diverging second split flow;

wherein the first split flow and the first portion of the fuel flow combine at the outlet of the primary air shroud to provide a first outlet fuel jet which exits the outlet of the primary air shroud;

wherein the second split flow and the second portion of the fuel flow combine at the outlet of the primary air shroud to provide a second outlet fuel jet;

wherein the first outlet fuel jet and second outlet fuel jet are divergent; and wherein the first splitter plate and the second splitter plate are divergent outwardly.

10. The nozzle tip of claim 9, wherein the first outlet fuel jet and the second outlet fuel jet exit the outlet of the primary air shroud separate and discrete from each other, and the first outlet fuel jet and the second outlet fuel jet remain separate and discrete from each other for a predetermined distance from the outlet of the primary air shroud.

11. The nozzle tip of claim 10, wherein the predetermined distance is in a range of approximately two (2) diameters of the first outlet fuel jet to approximately eight (8) diameters of the first outlet fuel jet, and the first outlet fuel jet and the second split flow at least partially combine after traveling the predetermined distance from the outlet of the primary air shroud into the pulverized solid fuel-fired furnace.

12. The nozzle tip of claim 9, further comprising at least one of a shear bar and a bluff point disposed on at least one of the first splitter plate and the second splitter plate.

13. The nozzle tip of claim 9, further comprising a secondary air shroud disposed around the primary air shroud.

14. The nozzle tip of claim 9, wherein the primary air shroud comprises:

at least one side plate;

a top plate; and a bottom plate, wherein the at least one side plate is connected between the top plate and the bottom plate.

15. The nozzle tip of claim 9, wherein the flow splitter is disposed between the first splitter plate and the second splitter plate.

16. The nozzle tip of claim 9, wherein the first portion of the fuel flow comprises approximately 30 percent of the fuel flow, the second portion of the fuel flow comprises approximately 40 percent of the fuel flow, and the third portion of the fuel flow comprises approximately 30 percent of the fuel flow.

17. The nozzle tip of claim 9, wherein the first outlet jet and the second outlet jet each comprise approximately 50 percent of the fuel flow.

18. The nozzle tip of claim 9, further including a flow splitter disposed within the primary air shroud, the flow splitter having a pair of diverging surfaces which separates the third portion of the fuel flow into the first split flow and the diverging second split flow.

19. The nozzle tip of claim 9, wherein at least one of the first splitter plate and second splitter plate are curved outwardly.

20. The nozzle tip of claim 9, wherein the primary shroud includes a first wall opposing the first splitter plate and a second wall opposing the second splitter plate, wherein the first wall and the second wall are divergent outwardly.

* * * * *